US007717513B2

(12) United States Patent
Ueda

(10) Patent No.: US 7,717,513 B2
(45) Date of Patent: May 18, 2010

(54) CHAIR

(75) Inventor: Nobuyuki Ueda, Osaka (JP)

(73) Assignee: Kokuyo Furniture Co., Ltd., Osaka (JP)

( * ) Notice: Subject to any disclaimer, the term of this patent is extended or adjusted under 35 U.S.C. 154(b) by 265 days.

(21) Appl. No.: 11/594,837

(22) Filed: Nov. 9, 2006

(65) Prior Publication Data

US 2007/0108819 A1 May 17, 2007

(30) Foreign Application Priority Data

Nov. 11, 2005 (JP) ..... 2005-328163

(51) Int. Cl.
*A47C 3/00* (2006.01)

(52) U.S. Cl. ..... 297/300.2

(58) Field of Classification Search ..... 297/300.1, 297/300.4, 300.5, 300.2
See application file for complete search history.

(56) References Cited

U.S. PATENT DOCUMENTS

| | | | | |
|---|---|---|---|---|
| 293,813 | A * | 2/1884 | St. John | 297/63 |
| 2,083,838 | A | 6/1937 | Goenen et al. | |
| 2,538,507 | A | 1/1951 | Cramer | |
| 3,133,763 | A | 5/1964 | Stoll et al. | |
| 3,938,858 | A | 2/1976 | Drabert et al. | |
| 4,090,700 | A | 5/1978 | Davis | |
| 4,549,764 | A | 10/1985 | Haedo | |
| 4,575,150 | A | 3/1986 | Smith | |
| 4,640,548 | A | 2/1987 | Desanta | |
| 4,709,963 | A | 12/1987 | Uecker et al. | |
| 4,830,430 | A | 5/1989 | Schafer | |
| 4,834,453 | A | 5/1989 | Makiol | |
| 4,869,552 | A | 9/1989 | Tolleson et al. | |
| 5,046,780 | A | 9/1991 | Decker et al. | |
| 5,172,930 | A | 12/1992 | Boye et al. | |

(Continued)

FOREIGN PATENT DOCUMENTS

DE 199 30 922 A1 5/2000

(Continued)

OTHER PUBLICATIONS

European Search Report dated Feb. 1, 2007, issued in corresponding European Application No. 06 12 3869.

(Continued)

*Primary Examiner*—Joseph F Edell
(74) *Attorney, Agent, or Firm*—Westerman, Hattori, Daniels & Adrian, LLP

(57) ABSTRACT

There is provided a chair that realizes a state preferably following a motion of a sitter in accordance with a posture of the relevant sitter, and a state preferably supporting the sitter. The chair includes a lower frame portion supported so as to be capable of rocking between a standing position and a rearward tilting position with respect to a base, and an upper frame portion supported so as to be capable of rocking between a normal position and a rear end position with respect to the relevant lower frame portion. Furthermore, upper frame portion biasing that elastically biases the upper frame portion from the rear end position to the normal position is provided. This upper frame portion biasing is adapted to change an elastically biasing force to the upper frame portion corresponding to a position in the rocking movement of the lower frame portion.

6 Claims, 21 Drawing Sheets

U.S. PATENT DOCUMENTS

| | | | | |
|---|---|---|---|---|
| 5,249,839 | A * | 10/1993 | Faiks et al. | 297/300.1 |
| 5,348,372 | A | 9/1994 | Takamatsu et al. | |
| 5,385,388 | A | 1/1995 | Faiks et al. | |
| 5,649,739 | A | 7/1997 | Zapf | |
| 5,904,397 | A | 5/1999 | Fismen | |
| 5,951,109 | A | 9/1999 | Roslund, Jr. et al. | |
| 5,988,746 | A | 11/1999 | Raftery | |
| 6,050,646 | A | 4/2000 | Stenzel et al. | |
| 6,056,361 | A | 5/2000 | Cvek | |
| 6,086,153 | A | 7/2000 | Heidmann et al. | |
| 6,116,687 | A | 9/2000 | Vogtherr | |
| 6,120,097 | A | 9/2000 | Perry et al. | |
| 6,149,236 | A | 11/2000 | Brauning | |
| 6,189,971 | B1 | 2/2001 | Witzig | |
| 6,220,661 | B1 | 4/2001 | Peterson | |
| 6,257,665 | B1 * | 7/2001 | Nagamitsu et al. | 297/285 |
| 6,406,096 | B1 | 6/2002 | Barile, Sr. | |
| 6,439,661 | B1 | 8/2002 | Brauning | |
| 6,460,928 | B2 | 10/2002 | Knoblock et al. | |
| 6,517,156 | B1 | 2/2003 | Lin | |
| 6,523,898 | B1 | 2/2003 | Ball et al. | |
| 6,565,153 | B2 | 5/2003 | Hensel et al. | |
| 6,572,190 | B2 | 6/2003 | Koepke et al. | |
| 6,609,755 | B2 * | 8/2003 | Koepke et al. | 297/300.2 |
| 6,672,669 | B2 | 1/2004 | Chu et al. | |
| 6,695,403 | B1 | 2/2004 | Su | |
| 6,695,404 | B2 | 2/2004 | Bruske | |
| 6,729,688 | B2 | 5/2004 | Erne | |
| 6,761,406 | B2 * | 7/2004 | Kinoshita et al. | 297/296 |
| 6,767,066 | B1 | 7/2004 | Tornero | |
| D497,264 | S | 10/2004 | Aubriet et al. | |
| 6,811,215 | B2 * | 11/2004 | Horiki et al. | 297/228.1 |
| 6,843,530 | B1 | 1/2005 | Wu | |
| 6,913,316 | B2 | 7/2005 | Kinoshita et al. | |
| 6,991,291 | B2 | 1/2006 | Knoblock et al. | |
| 7,014,269 | B2 | 3/2006 | Coffield et al. | |
| 7,066,537 | B2 | 6/2006 | Coffield et al. | |
| 7,118,176 | B2 | 10/2006 | Erker | |
| 7,134,722 | B2 | 11/2006 | Ueda et al. | |
| 7,226,127 | B1 | 6/2007 | Yevko et al. | |
| 7,273,253 | B2 | 9/2007 | Deimen et al. | |
| 7,396,079 | B2 | 7/2008 | Heidmann et al. | |
| 7,422,287 | B2 | 9/2008 | Heidmann et al. | |
| 7,434,879 | B2 * | 10/2008 | Ueda et al. | 297/296 |
| 2002/0180248 | A1 | 12/2002 | Kinoshita et al. | |
| 2002/0180250 | A1 | 12/2002 | Kinoshita et al. | |
| 2002/0180252 | A1 | 12/2002 | Kinoshita et al. | |
| 2002/0190553 | A1 | 12/2002 | Koepke et al. | |
| 2002/0190555 | A1 | 12/2002 | Holbrook et al. | |
| 2003/0127896 | A1 * | 7/2003 | Deimen et al. | 297/301.1 |
| 2004/0012237 | A1 | 1/2004 | Horiki et al. | |
| 2004/0066075 | A1 | 4/2004 | Yeh | |
| 2004/0140701 | A1 | 7/2004 | Schmitz et al. | |
| 2004/0183350 | A1 | 9/2004 | Schmitz et al. | |
| 2007/0108819 | A1 | 5/2007 | Ueda | |
| 2007/0108820 | A1 | 5/2007 | Ueda | |
| 2007/0108821 | A1 | 5/2007 | Ueda | |
| 2007/0108822 | A1 | 5/2007 | Ueda | |
| 2007/0108831 | A1 | 5/2007 | Ueda | |
| 2008/0030059 | A1 | 2/2008 | Deimen et al. | |

FOREIGN PATENT DOCUMENTS

| | | | |
|---|---|---|---|
| DE | 101 47 021 | | 4/2003 |
| EP | 0 259 609 | | 3/1988 |
| EP | 0 552 388 | A1 | 7/1993 |
| EP | 1 447 029 | | 8/2004 |
| FR | 2627968 | A1 | 9/1989 |
| GB | 610741 | | 10/1948 |
| GB | 2 143 730 | A | 2/1985 |
| JP | 61041028 | A | 2/1986 |
| JP | 2616332 | B2 | 6/1997 |
| JP | 2002-119373 | A | 4/2002 |
| JP | 2002-119375 | A | 4/2002 |
| JP | 2003-265256 | A | 9/2003 |
| NL | 7 804 978 | A | 11/1978 |
| WO | WO 86/02243 | | 4/1986 |
| WO | WO 94/27472 | A1 | 12/1994 |
| WO | WO 00/22961 | A1 | 4/2000 |

OTHER PUBLICATIONS

European Office Action dated Mar. 29, 2007, Application No. 06123872.1-1258 of co-pending U.S. Appl. No. 11/594,835.

European Search Report dated Apr. 16, 2007 issued in corresponding EP Application No. 06123876.2-1258 of co-pending U.S. Appl. No. 11/594,858.

European Search Report dated Jan. 30, 2007 issued in corresponding European Application No. 06 12 3875 of co-pending U.S. Appl. No. 11/594,836.

European Search Report dated Feb. 1, 2007, issued in corresponding application EP 06 12 3869 of co-pending U.S. Appl. No. 11/594,837.

European Search Report dated Feb. 16, 2007, issued in corresponding application EP 06 12 3871.

European Search Report dated Mar. 12, 2007, issued in corresponding application EP 06 12 3874 of co-pending U.S. Appl. No. 11/594,834.

* cited by examiner

CHAIR

BACKGROUND OF THE INVENTION

1. Field of the Invention

The present invention relates to a chair whose backrest can be tilted rearward.

2. Description of the Related Art

Conventionally, there has been disclosed a chair in which a backrest surface is made up by extending an upholstery member between frame elements, which make a pair on both right and left sides. For example, there has been disclosed a chair employing a structure in which an upper portion of the backrest surface is supported by upper frame elements and a lower portion of the backrest surface is supported by lower frame elements, and these upper frame elements and lower frame elements are made independent to perform rotational operation around a horizontal axis, that is, rocking movement (for example, refer to Japanese Patent Application Laid-Open No. 2002-119375 and Japanese Patent Application Laid-Open No. 2002-119373). Furthermore, in the chair having such a constitution, by providing elastically biasing means that elastically biases the lower frame elements forward and elastically biasing means that biases the upper frame elements forward, independently of each other, the backrest surface capable of following, for example, a motion of the entire upper body of a sitter by the motion of his or her waist, and for example, a motion of only an upper portion of the upper body such as turning back and extending his or her arm laterally is realized.

In everyday life, when seated with his or her upper body standing in a chair, a sitter often turns back, extends his or her arm, twists himself or herself and so on. With respect to such motions of the sitter, in the chairs described in the Japanese Patent Application Laid-Open No. 2002-119375 and Japanese Patent Application Laid-Open No. 2002-119373, the upper frame elements follow the motions of the upper body of the sitter, particularly the upper portion with a required elastically biasing force.

However, when the sitter tilts his or her upper body rearward, the backrest is required to surely support the upper body of the sitter. That is, the elastically biasing force of such a degree that the upper frame elements of the backrest can move in accordance with the motion of the upper body of the sitter as described above does not allow the upper portion of the upper body to be stably supported. In such a chair, there may arise a defect that when the sitter inclines his or her upper body by tilting the lower frame elements of the backrest rearward, the sitter feels insecure.

SUMMARY OF THE INVENTION

The present invention has been made in light of the above-described problem, and is intended to provide a chair that realizes a state preferably following a motion of a sitter in accordance with a posture of the relevant sitter and a state preferably supporting the sitter.

The present invention takes the following measures in order to the above-described object. That is, a chair according to the present invention is a chair having at least a leg body, a base supported by the leg body, and a back frame supported by the base, the aforementioned back frame comprising a lower frame portion supported so as to be capable of rocking between a standing position and a rearward tilting position with respect to the base, and an upper frame portion supported so as to be capable of rocking between a normal position and a rear end position with respect to the relevant lower frame portion, wherein upper frame portion biasing means that elastically biases the aforementioned upper frame portion from the aforementioned rear end position to the aforementioned normal position is provided, and the relevant upper frame portion biasing means is constituted so as to change an elastically biasing force to the aforementioned upper frame portion corresponding to a position with respect to the aforementioned base in the aforementioned rocking movement of the aforementioned lower frame portion.

Here, the present invention includes an aspect in which the elastically biasing force to the upper frame portion becomes weaker as the lower frame portion is tilted rearward, and an aspect in which the elastically biasing force to the upper frame portion becomes stronger.

With the above-described constitution, the elastically biasing force to the upper frame portion can be set in accordance with a posture of a sitter, particularly, a posture of the upper body. That is, in the case where a shape of a backrest of the chair is desired to follow the motion of the upper body of the sitter, the elastically biasing force to the upper frame portion is set weaker, and in the case where the upper body of the sitter is desired to be supported by the backrest, the elastically biasing force to the upper frame portion can be set stronger. As a result, the chair having the backrest serving differently in accordance with the posture of the sitter, particularly the posture of the upper body, can be provided.

In the posture in which the sitter raises his or her upper body, the elastically biasing force is set weaker to make it easy to follow the motion of the upper body of the sitter, while in the posture in which the sitter inclines his or her upper body, the elastically biasing force is set stronger to make it easy to support the upper body of the sitter. For this, the upper frame portion biasing means is preferably adapted such that the elastically biasing force is set stronger as the lower frame portion becomes closer to the rearward tilting position.

As a specific constitution for preferably making up the upper frame portion biasing means, there can be cited an aspect in which the upper frame portion biasing means is made of an elastic member provided between the upper frame portion and the lower frame portion, and an aspect in which the upper frame portion biasing means is made of an elastic member provided between the base and the upper frame portion.

As a more specific constitution in the former case, a constitution can be cited in which the elastic member is made of a torsion coil spring, whose one end side and another end side are locked in the upper frame portion and the lower frame portion, by which there is provided repulsive force changing means capable of changing an initial repulsive force of the torsion coil spring by changing a locking position of the torsion coil spring as the lower frame portion becomes closer to the rearward tilting position. The above-described constitution allows the upper frame portion biasing means to be provided compactly in a portion between the upper frame portion and the lower frame portion.

In the latter case, a constitution is realized in the elastically biasing force to the upper frame portion can be varied in accordance with a relative position between the lower frame portion and the base without providing special means. In both the former and latter cases, to provide the upper frame portion biasing means with a simple constitution, it is preferable that the elastic member is made of a frame-like spring. Here, "frame-like" refers to an aspect in which a spring extends along a frame to which the spring is attached, or stretches along the relevant frame. The "frame-like spring" may be a resin spring formed into a frame, or may be a spring steel plate cut into a frame. Also, a spring steel plate to which resin coating is applied is included.

Particularly, such a frame-like spring can be the elastic member capable of preferably exerting the elastically biasing force even when it is provided between the base and the upper frame, which are apart from each other via the lower frame portion, as described above.

As a specific desirable aspect of the upper frame portion biasing means in the case where the frame-like spring is employed, there can be cited an aspect in which supporting position changing means capable of changing a supporting position where the frame-like spring is supported corresponding to the rocking movement of the lower frame portion is provided. Furthermore, as another desirable aspect, there can be cited an aspect in which a supporting point forming member that comes into contact with an intermediate portion of a frame-like spring to change the elastic repulsive force of the frame-like spring, and supporting point changing means capable of changing a fixing position of the supporting point forming member corresponding to the rocking movement of the lower frame portion are provided.

For the constitution in which the motion of the upper body is not hindered when the sitter raises his or her body, and the upper body of the sitter is preferably supported when the sitter inclines his or her upper body rearward, it is preferably to further provide a movement range setting mechanism that sets a movement range of the upper frame portion narrower as the lower frame portion becomes closer to the rearward tilting position. Also, in this case, in order to preferably incline the upper body of the sitter when the lower frame portion is tilted, the movement range setting mechanism may be adapted such that the rear end portion of the upper frame portion becomes closer to the normal position as the lower frame portion becomes closer to the rearward tilting position. Here, the narrower movement range also includes an aspect in which the upper frame portion is fixed so as to be incapable of moving. That is, the movement range setting mechanism may be adapted to prohibit the movement of the upper frame portion in an arbitrary position while the lower frame portion is tilted from the standing position to the rearward tilting position. With such a constitution, the upper body of the sitter when inclined rearward can be preferably supported.

Moreover, as desired by the sitter, as a constitution in which the movement range setting mechanism can switch between on and off, a switching mechanism for temporarily stopping the function of the movement range setting mechanism is desirably provided.

Additionally, in order to make up the chair capable of faithfully moving in accordance with the motion of the upper body of the sitter, it is desirable that the upper frame portion has a pair of upper frame elements arranged on the right and left sides, and that the relevant pair of upper frame elements is supported so as to be capable of rocking independently of each other between the normal position and the rear end position with respect to the relevant lower frame portion.

According to the present invention, in the case where the shape of the backrest of the chair is desired to follow the motion of the upper body of the sitter, the elastically biasing force of the upper frame portion is set weaker, and in the case where the upper body of the sitter is desired to be supported by the backrest, the elastically biasing force to the upper frame portion can be set stronger. As a result, it can be provided a chair having a backrest serving in accordance with the posture of the sitter.

DESCRIPTION OF THE PREFERRED EMBODIMENTS

Figure 1:
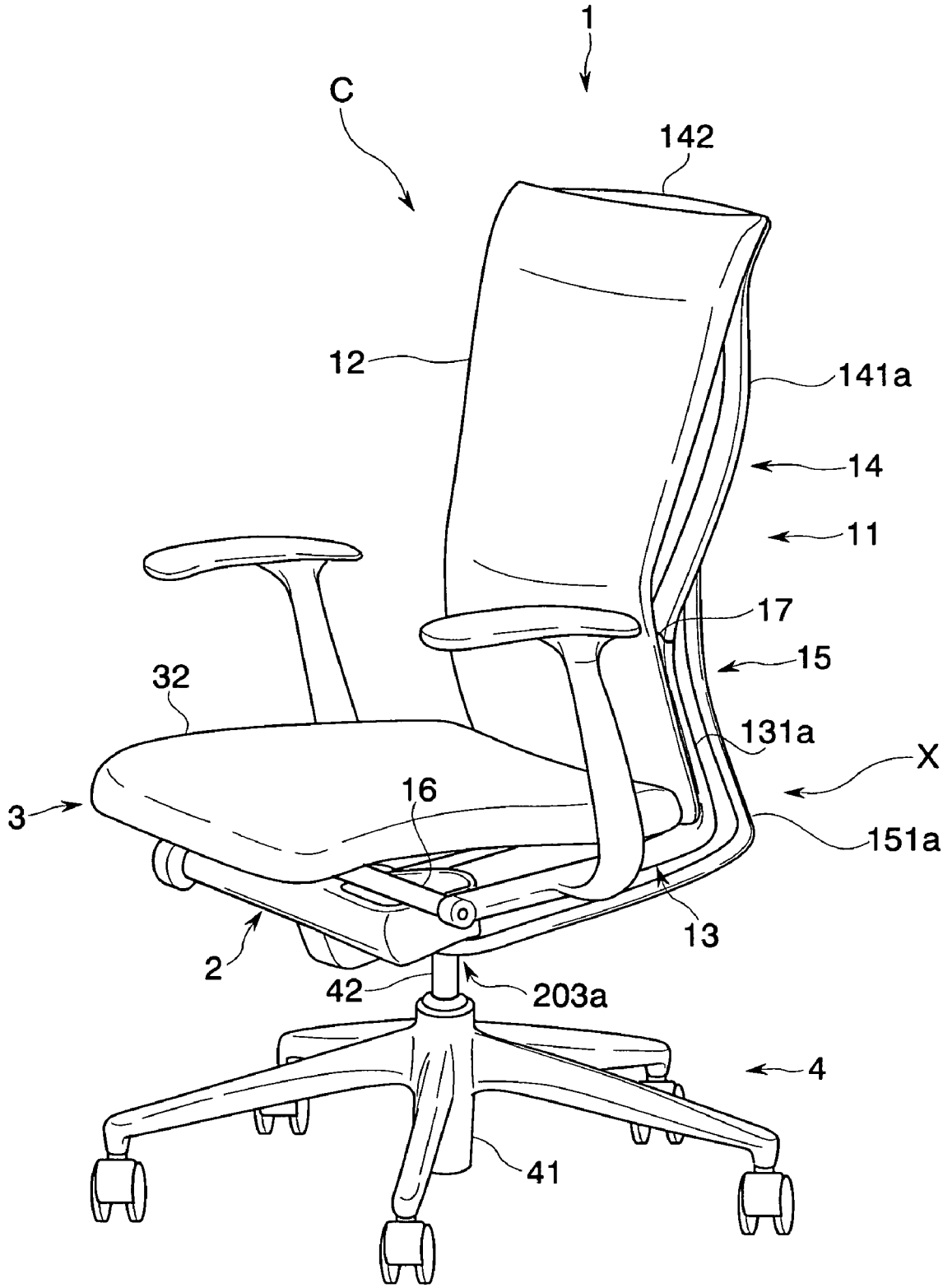
FIG. 1 is an appearance view of a chair according to a first embodiment of the present invention.
Figure 2:
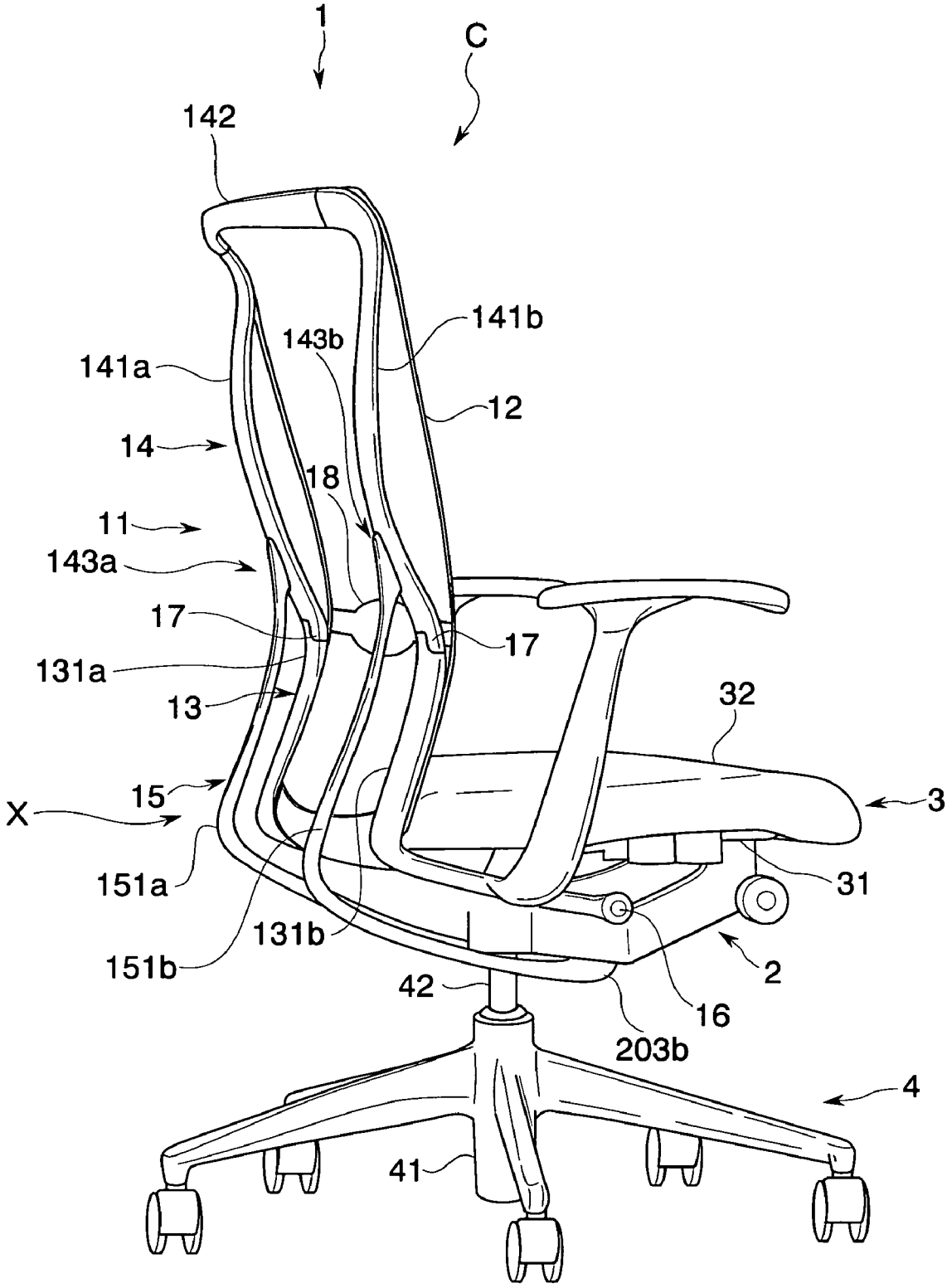
FIG. 2 is an appearance view of the chair according to the first embodiment of the present invention.

Hereinafter, embodiments of the present invention are described with reference to the drawings.

First Embodiment

A first embodiment of the present invention is described with reference to the drawings. A chair C of the present embodiment, as shown in FIGS. 1 to 5, includes a leg body 4, a base 2 supported by the leg body 4, a seat 3 arranged on the base 2, and a backrest 1 attached to the base 2 pivotally through a horizontal shaft 16, and is capable of synchronous rocking movement in which the seat 3 and the backrest 1 are interlocked and tilted rearward.

In this case, the chair C according to the present embodiment includes a lower frame portion 13 supported so as to be capable of rocking between a standing position (S) and a rearward tilting position (T) with respect to the base 2, and an upper frame portion 14 supported so as to be capable of rocking between a normal position (N) and a rear end position (E) with respect to the relevant lower frame portion 13. Furthermore, upper frame portion biasing means X that elastically biases the upper frame portion from the rear end portion (E) toward the normal position (N) is provided. Moreover, this upper frame portion biasing means X is constituted so as to change an elastically biasing force to the upper frame portion 14 corresponding to a position in the rocking movement of the lower frame portion 13. The relevant upper frame portion biasing means X will be described in detail later.

Hereinafter, respective components in the chair C are described in detail with reference to FIGS. 1 to 9.

The leg body 4, as shown in FIGS. 1 to 4, is provided with a leg wing 41 with a plurality of casters mounted and a leg support pillar 42 rising from the center of the leg wing 41 substantially vertically, and the leg support pillar 42 can be projected or sunk vertically by expansion and contraction of a gas spring (not shown in the figure) arranged between the leg wing 41 and the leg support pillar 42.

The base 2, as shown in FIGS. 1 to 4, is fixed to an upper end of the leg support pillar 42 and height positions of the seat 3 and the backrest 1 can be adjusted through projecting and sinking movement of the leg support pillar 42. On the lower surface side of the base 2, there are provided base attaching portions 203*a*, 203*b* for attaching reactive force frame elements of a reactive force frame portion 15, which will be described later. Moreover, the base 2 incorporates an elastically biasing mechanism (not shown in the figure) that biases forward the backrest 1 rotating around the horizontal shaft 16, a fixing mechanism (not shown in the figure) that fixes a rocking angle of the backrest 1, and the like. The elastically biasing mechanism mounts a coil spring or a gas spring to elastically bias a back frame 11. The fixing mechanism fixes the rocking angle, for example, by selectively engaging a claw with any one of a plurality of steps of depressions provided on the back frame 11 side, and in the case where a push-lock type gas spring is used for the elastically biasing mechanism, an aspect in which a valve thereof is driven to prohibit expansion and contraction movement of the gas spring may be taken.

The seat 3, as shown in FIGS. 1 to 5, is made up by mounting a cushion body 32 making up a seat surface on a seat receiver 31. The cushion body 32 has, for example, a two-layer structure in which a urethane cushion material is superimposed on a double raschel mesh made of synthetic fiber, the mesh of the lower layer maintaining appropriate elasticity while absorbing impact, and the urethane cushion material of the upper layer maintaining the stability in style and shape. A front end portion of the seat 3 is supported slidably in an back and forth direction with respect to the base 2, and a rear end portion of the seat 3 is attached to the lower frame portion 13 in the back frame 11 described below through hinges (not shown in the figure).

The backrest 1, as shown in FIGS. 1 to 5, is made up by extending an upholstery member 12 making up a backrest surface in front of the back frame 11. The back frame 11 includes the lower frame portion 13 jointed to the base 2 rotatably around the horizontal shaft 16, the upper frame portion 14 jointed to upper ends of the lower frame portion 13 through hinges 17, and the reactive force frame portion 15 supporting the upper frame portion 14 from the rear side.

In the lower frame portion 13, right and left lower frame elements 131*a*, 131*b* arranged apart from each other in a width direction are jointed mutually through a rigid lateral bridging member 132, as shown in FIGS. 1 to 4. The lower frame elements 131*a*, 131*b* and the rigid lateral bridging member 132 are, for example, rigid bodies made of metal. Each of the lower frame elements 131*a*, 131*b* extends rearward from a front end thereof where the horizontal shaft 16 is located, and forms a substantially L shape bent upward at a rear end thereof in a side view.

In the upper frame portion 14, right and left upper frame elements 141*a*, 141*b* arranged apart from each other in the width direction are jointed mutually through an elastic lateral bridging member 142 as shown in FIGS. 1 to 4. The upper frame elements 141*a*, 141*b* are, for example, rigid bodies made of metal, while the elastic lateral bridging member 142 is, for example, an elastic body made of resin. Each of the upper frame elements 141*a*, 141*b* extends upward from a lower end thereof where the hinge 17 is located while curving moderately so as to be slightly depressed rearward, and forms an arc that swells forward again in the vicinity of an upper end thereof in a side view.

The reactive force frame portion 15, as shown in FIGS. 1 to 4, is made of reactive force frame elements 151*a*, 151*b*, which are the same number of frame-like springs supporting the upper frame elements 141*a*, 141*b*, respectively. Upper portions 153*a*, 153*b*, which are one-end portions of the reactive force frame elements 151*a*, 151*b*, are connected to upper attachment portions 143*a*, 143*b* of the upper frame elements 141*a*, 141*b*, and lower end portions 152*a*, 152*b*, which are other-end portions, are connected to the base attachment portions 203*a*, 203*b* provided in a downside surface of the base 2. However, as described later, the lower end portions 152*a*, 152*b* of the reactive force frame elements 151*a*, 151*b* are not hindered from being fixed to the base 2 supporting the seat 3 and the backrest 1. The reactive force frame elements 151*a*, 151*b* are elastic bodies made of the same resin as that of the elastic lateral bridging member 142, for example. In the present embodiment, the reactive force frame elements 151*a*, 151*b* are frame-like springs that extend along the lower frame elements 131*a*, 131*b* and the upper frame elements 141*a*, 141*b* so as to form a substantially L shape in a side view, and are formed such that a width dimension is almost the same as, or a little narrower than, that of the frame elements 131*a*, 131*b*, 141*a*, 141*b*, and thicknesses of the longitudinal part and vertical part thereof are thinner than that of the frame elements 131*a*, 131*b*, 141*b*, 141*b* (in addition, it becomes gradually thinner away from the end portions where they are jointed to the base 2 and the upper frame elements 141*a*, 141*b*). With the above-described constitution, an appearance is formed as if the reactive force frame elements 151*a*, 151*b* are a part of the back frame 11, which branches from the upper frame elements 141*a*, 141*b*.

In a range of a vicinity of each of the hinges 17 pivotally supporting the lower frame elements 131*a*, 131*b* and the upper frame elements 141*a*, 141*b*, more specifically, a range of a portion from the rear end of each of the lower frame elements 131, 131*b* to a vicinity of the upper end thereof, and a range of a vicinity of the lower end of each of the upper frame elements 141*a*, 141*b*, a curve is formed such that a front surface of the frame swells forward in a side view. As described before, in the vicinity of the upper end of each of the upper frame elements 141*a*, 141*b*, a curve is also formed so that the front surface of the frame swells forward in a side view. Thus, the upholstery member 12 is extended so as to bridge between the portions forming the above-described curves of the lower frame elements 131*a*, 131*b* and the upper frame elements 141*a*, 141*b*.

The upholstery member 12, as shown in FIGS. 1 to 5, is mainly made of an upholstery material having rich stretch properties. The upholstery material is obtained, for example, by further weaving an elastic thread such as an elastomer thread into double raschel mesh made of synthetic fiber, having both strength and cushioning properties. The upholstery material differs in appearance (color, pattern, luster or the like) between the front and the back sides. At an upper side and right and left sides of the upholstery material, the shape of the upholstery material is maintained by a backup member (not shown in the figure) forming a three-side frame or four-side frame in a front view. The backup member is, for example, a thin plate body made of resin, which particularly prevents the right and left sides of the upholstery material from sagging inward, and keeps the upholstery material strained. An upper end portion of the upholstery member 12 is attached to the right and left upper frame elements 141*a*, 141*b* to be supported, and a lower end portion is attached to the right and left lower frame elements 131*a*, 131*b* to be supported. At this time, the backup member acts as a plate spring, pushing the upholstery material forward to throw it out.

A lumber support belt 18 can also be laid in a position of a height corresponding to the waist of the sitter behind the upholstery member 12. Even when the sitter leans his or her body against the backrest surface, the portion where the lumber support belt 18 is laid does not sink rearward at a depth larger than a depth in accordance with a length of the lumber support belt 18.

Figure 6:
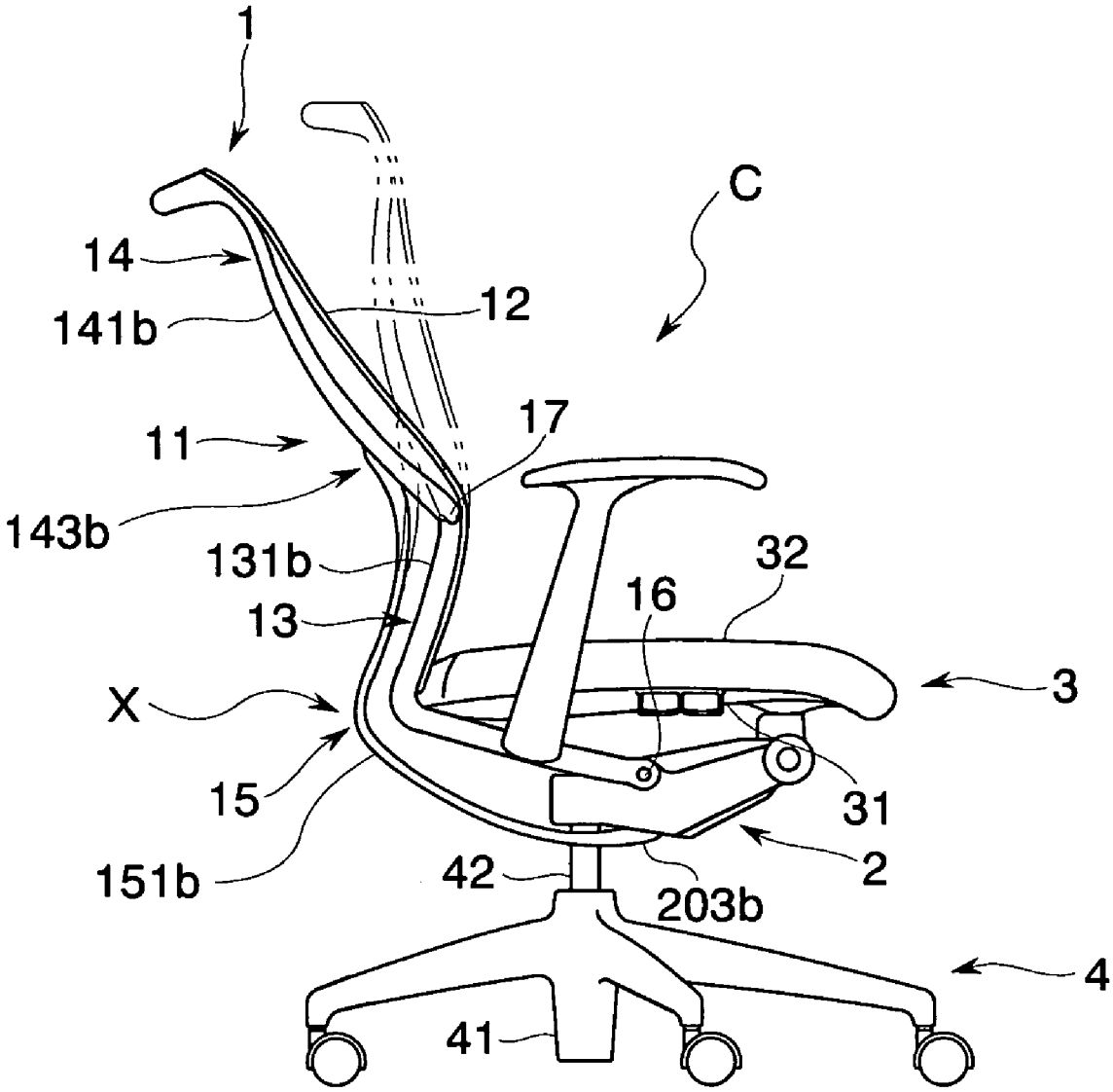
FIG. 6 is a view for explaining a movement, corresponding to FIG. 3.

The chair C of the present embodiment is capable of synchronous rocking movement in which the seat 3 and the backrest 1 are interlocked and tilted. As shown in FIG. 6, in the synchronous rocking movement, the rotation of the entire back frame 11 around the horizontal shaft 16 allows the backrest 1 to tilt back and forth. At the same time, the rear end portion of the seat 3 is interlocked with the back frame 11 to swing vertically, and the front end portion of the seat 3 slides back and forth.

Figure 7:
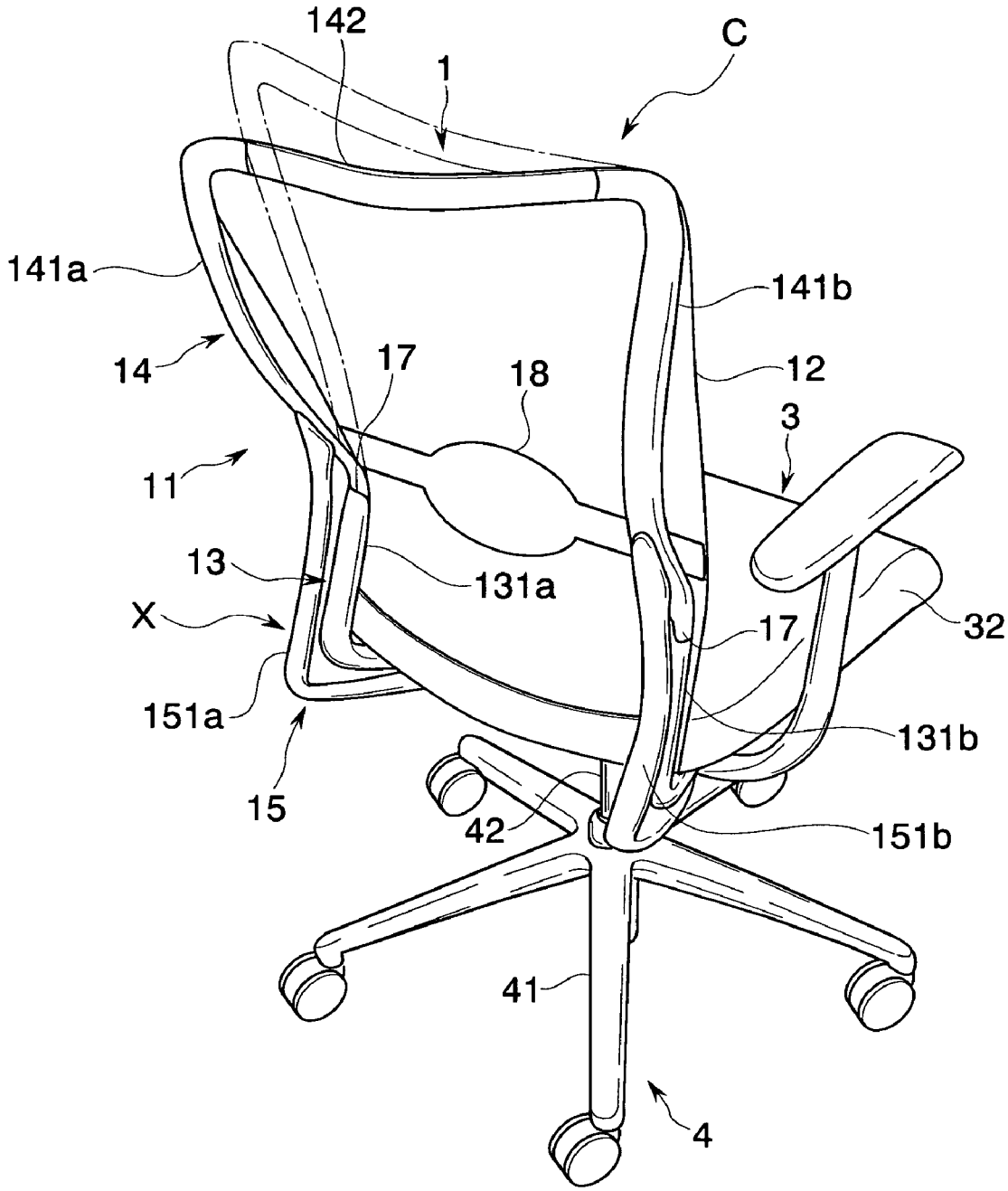
FIG. 7 is a view for explaining the movement, corresponding to FIG. 2.
Figure 8:
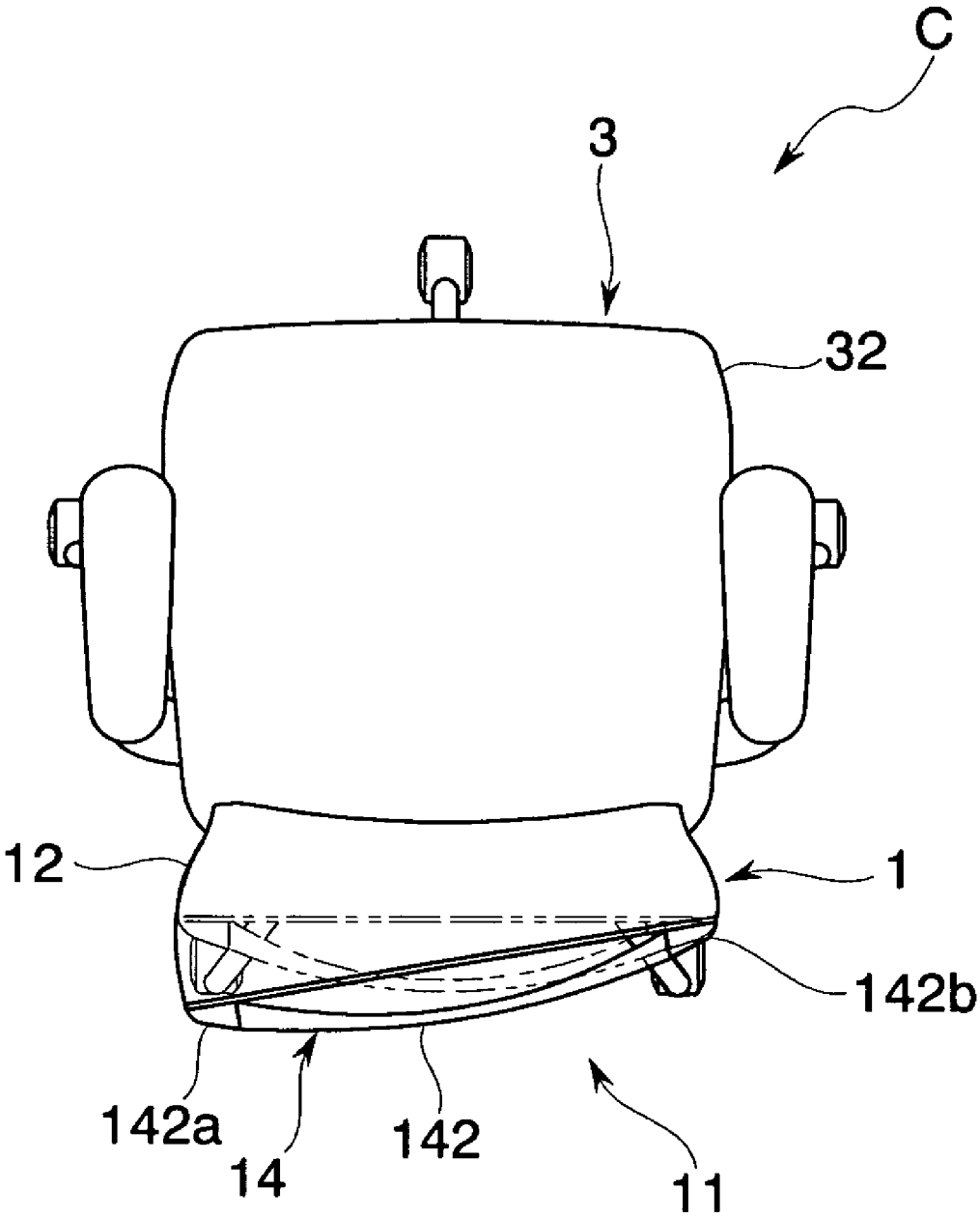
FIG. 8 is a view for explaining the movement, corresponding to FIG. 5.

With the above-described constitution, as shown in FIGS. 7 and 8, the chair C of the present embodiment is capable of movement in which only a left half portion or only a right half portion of an upper portion of the backrest surface is displaced rearward following the sitter's motion of turning back, extending his or her arm, or twisting his or her body while the sitter stays seated. In the upper frame portion 14 supporting the upper portion of the backrest surface, the upper fame elements 141*a*, 141*b* making a pair on both right and left sides move back and forth independently of each other. That is, the upper frame element 141*a* on the left side is jointed to the lower frame element 131*a* on the left side through the hinge 17, the upper frame elements 141*b* on the right is jointed to the lower frame element 131*b* on the right side through the hinge 17, and these upper frame elements 141*a*, 141*b* can rotate individually.

As shown in FIG. 7, when the upper frame elements 141*a*, 141*b* are tilted rearward around the hinges 17, an area where the upholstery member 12 contacts the portions forming curves of the lower frame elements 131*a*, 131*b* and the upper frame elements 141*a*, 141*b* gradually increases, and the upholstery material stretches vertically while increasing tension. Furthermore, the reactive force frame elements 151*a*, 151*b* deform so as to increase the angle to accumulate reactive force to elastically bias the upper frame elements 141*a*, 141*b* in a direction in which the upper frame elements 141*a*, 141*b* are restored to the original positions, that is, forward.

Figure 9:
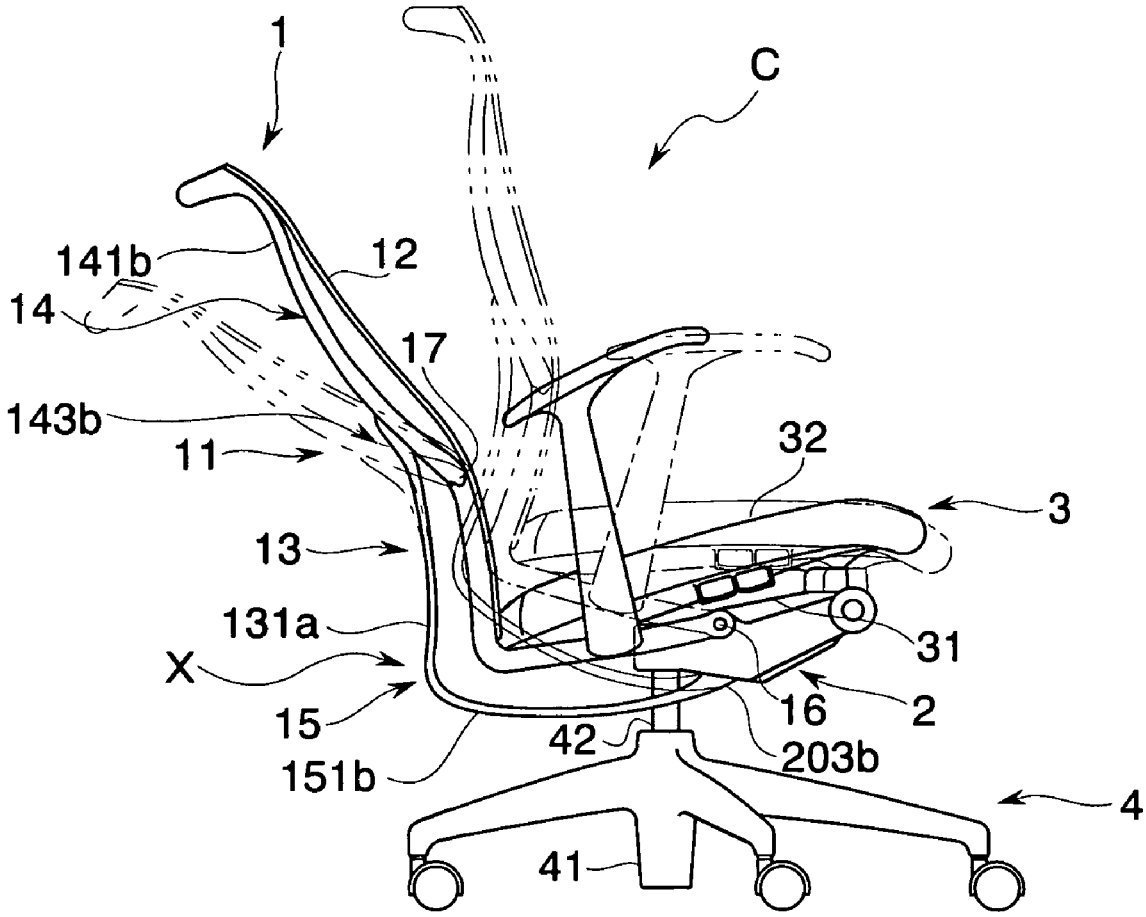
FIG. 9 is a view for explaining the movement, corresponding to FIG. 3.

One of the upper frame elements 141*a*, 141*b* is displaced relative to the other of the upper frame elements 141*a*, 141*b* in the backward and forward directions, by which the shape of the backrest surface can be changed three-dimensionally, as shown in FIGS. 8, 9. In this movement, the lower frame portion 13 is not necessarily driven. Furthermore, since the lower frame elements 131*a*, 131*b*, which make a pair on the right and left sides, are rigidly jointed through the rigid lateral bridging member 132, these lower frame elements 131*a*, 131*b* are always interlocked integrally. Therefore, a shape of a lower portion of the backrest surface, that is, portion lower than the waist of the sitter is always kept constant.

When one of the upper frame elements 141*a*, 141*b* moves back and forth relative to the other with a motion of the sitter, a distance between the right and left upper frame elements 141*a*, 141*b* increases. At this time, the elastic lateral bridging member 142 is deformed elastically so as to correspond to the increase in separate distance of both the upper frame elements 141*a*, 141*b*. The elastic lateral bridging member 142 of the present embodiment joints the upper end portions of the upper frame elements 141*a*, 141*b* to each other, and is assembled in a state forming a curve depressed rearward in a plane view. A thickness in the back and forth direction of the elastic lateral bridging member 142 gradually becomes smaller toward the center in the width direction from both the end portions joining the upper frame elements 141*a*, 141*b*, which makes a central portion easier to deform than both the end portions. This is intended to avoid concentration of load on the joining points between the upper frame elements 141*a*, 141*b* and the elastic lateral bridging member 142. When one of the upper frame elements 141*a*, 141*b* moves back and forth relative to the other, the elastic lateral bridging member 142 deforms so as to reduce a curvature, thereby lengthening the distance between both the ends.

Additionally, the load of the sitter that the backrest surface receives acts on the upper frame elements 141*a*, 141*b* through the upholstery member 12, and tries to bring the upper frame elements 141*a*, 141*b* down inward, which applies load to the hinges 17. For the purpose of negating and reducing such load, the elastic lateral bridging member 142 is assembled in a state exerting an initial elastic force that sets apart the upper frame elements 141*a*, 141*b* in the width direction.

Also, the right and left upper frame elements 141*a*, 141*b* can be tilted together. In this case, for example, stretch enough to allow the sitter to largely bend himself or herself backward is possible.

Thus, the chair C according to the present embodiment is characterized in that the upper frame portion biasing means X is constituted so as to change the elastically biasing force to the upper frame portion 14 corresponding to the rocking movement of the lower frame portion 13, as described above.

Hereinafter, a specific constitution of the upper frame portion biasing means X is described in detail with reference to FIGS. 3, 6 and 9.

Figure 3:
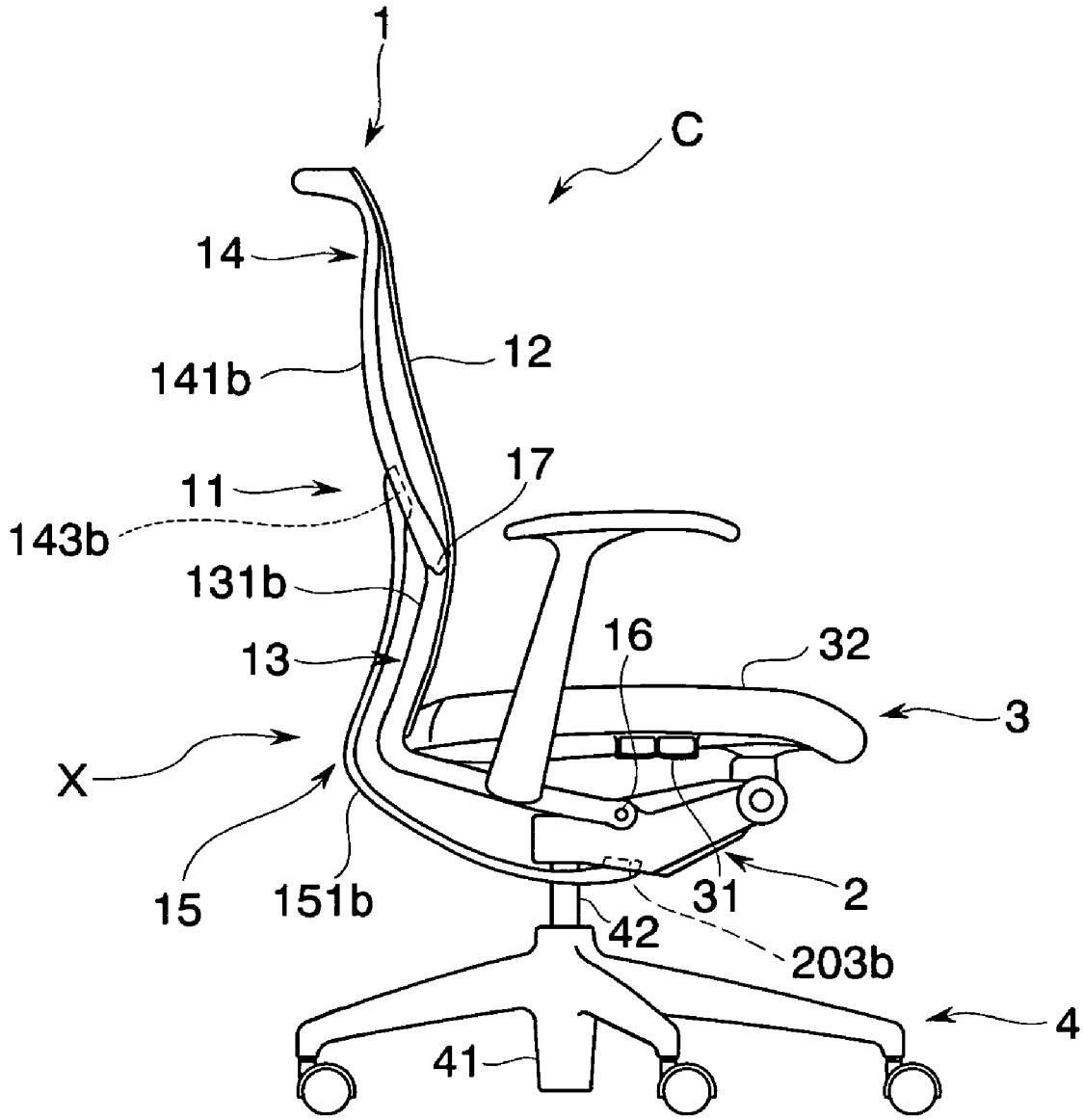
FIG. 3 is a side view of the chair according to the first embodiment of the present invention.
Figure 4:
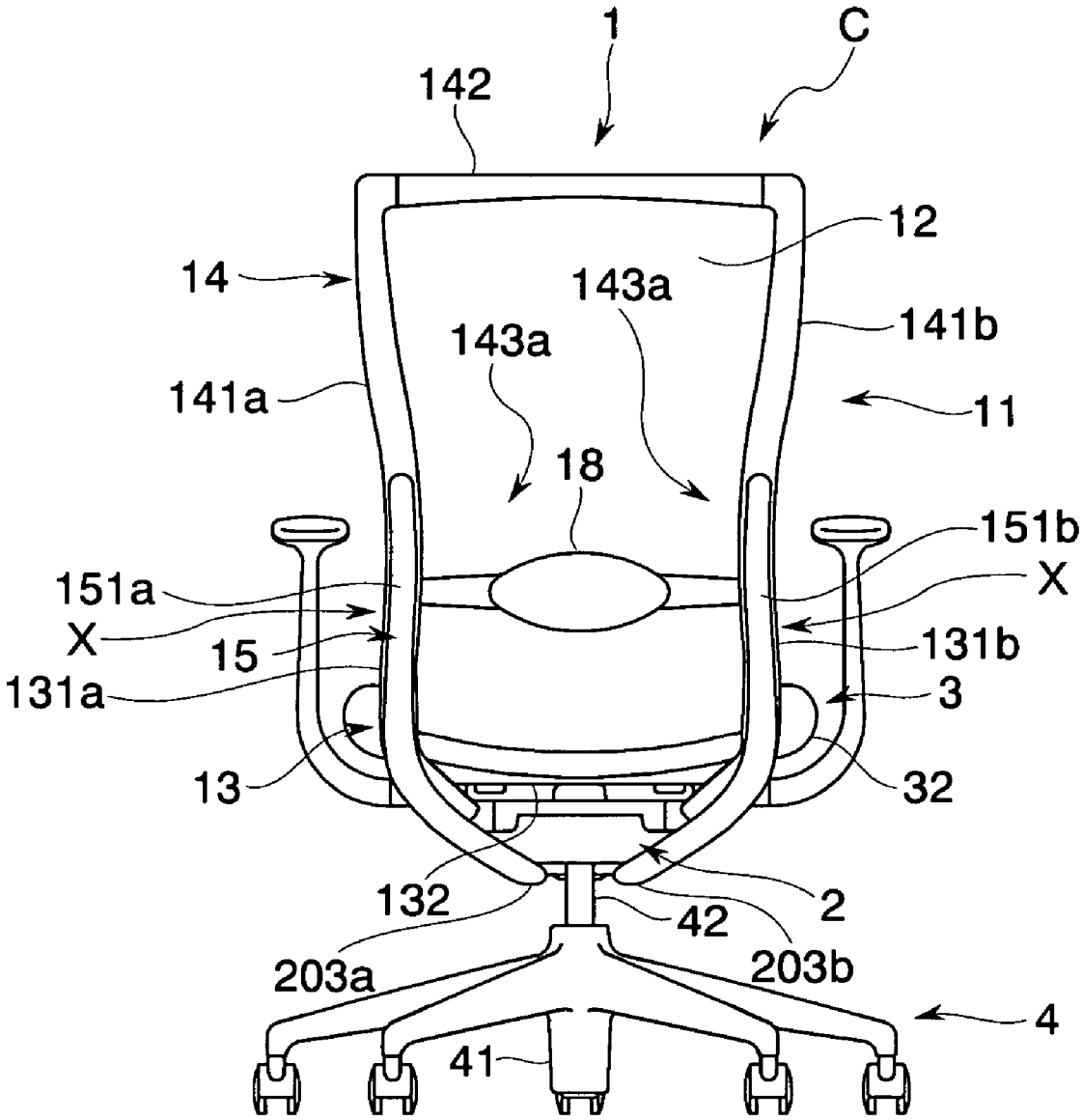
FIG. 4 is a rear view of the chair according to the first embodiment of the present invention.
Figure 5:
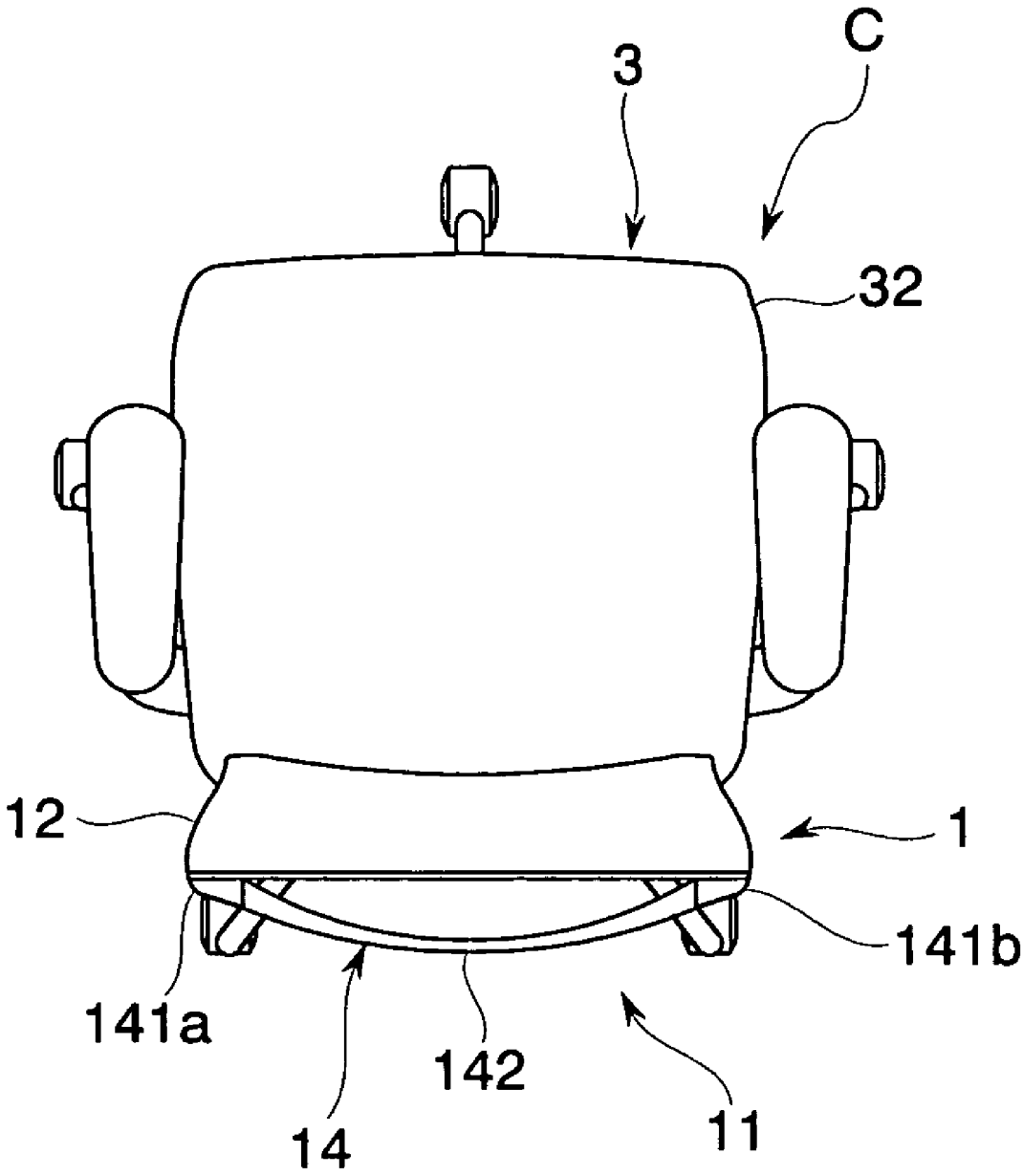
FIG. 5 is a top view of the chair according to the first embodiment of the present invention.

First, in a posture shown in FIGS. 3 and 6, that is, when the lower frame portion 13 is in a standing position (S), the upper frame elements 141*a*, 141*b* are in the state where the predetermined elastically biasing force is applied by the reactive force frame elements 151*a*, 151*b*. The lower frame portion 13 falls toward a rearward tilting position (T), and thereby, the upper attachment portions 143*a*, 143*b* of the upper frame elements 141*a*, 141*b* that attach the reactive force frame elements 151*a*, 151*b* and the base attachment portions 203*a*, 203*b* of the base 2 become closer in relative position, and the reactive force frame elements 151*a*, 151*b* enter an inflected state, thereby entering a state where an elastic repulsive force is increased. As shown in FIG. 9, when the lower frame portion 13 is located in the rearward tilting position (T), the upper attachment portions 143*a*, 143*b* and the base attachment portions 203*a*, 203*b* become the closest, and thus, the elastic repulsive force is accumulated most. Thus, the elastic repulsive force of the reactive force frame elements 151*a*,

151*b* increases as the lower frame portion 13 becomes closer to the rearward tilting position (T). In other words, the reactive force frame portion 15 is provided between the base 2 and the upper frame portion 14 to make up the upper frame portion biasing means X, which realizes the constitution in which the elastically biasing force of the reactive force frame elements 151*a*, 151*b* to the upper frame elements 141*a*, 141*b* is set stronger as the lower frame portion 13 becomes closer to the rearward tilting position (T).

As described above, in the chair C according to the present embodiment, since the relevant upper frame portion biasing means X is constituted so as to change the elastically biasing force to the upper frame portion 14 corresponding to the rocking movement of the lower frame portion 13, the constitution is realized as described above, in which as the lower frame portion 13 becomes closer to the rearward tilting position (T) from the state where the lower frame portion 13 is in the standing position (S), the elastically biasing force of the reactive force frame elements 151*a*, 151*b* increases. This realizes the constitution in which the chair may be gradually changed from an aspect easy to follow the back of the sitter to an aspect easy to support the back. This allows for the constitution in which the backrest 1 matches the posture of the sitter. Specifically, in one and the same chair C can be preferably realized two contrary characteristics required to the backrest 1; in the state where the lower frame portion 13 is in the standing position (S), the backrest 1 preferably moves following the back, while in the state where the lower frame portion 13 is in the rearward tilting position (T), the backrest 1 preferably supports the back of the sitter.

The above-described upper frame portion biasing means X capable of changing such elastically biasing force to the upper frame elements 141*a*, 141*b* can be made up with the simple constitution in which the reactive force frame elements 151*a*, 151*b*, which are elastic members, are attached between the base 2 and the upper frame portion 14. More particularly, the constitution in which the elastically biasing force to the upper frame portion 14 is varied by utilizing the change in relative position of the lower frame portion 13 and the base 2 is preferably realized. Furthermore, by employing the reactive force frame elements 151*a*, 151*b* which are frame-like springs, the reactive force frame elements 151*a*, 151*b* can preferably exert the elastically biasing force even when they are provided between the base 2 and the upper frame elements 141*a* 141*b* which are apart from each other through the lower frame portion 13.

Furthermore, in the present embodiment, the upper frame portion 14 is made of the pair of upper frame elements 141*a*, 141*b* that can move independently, and particularly, when the lower frame portion 13 is in the standing position (S) or is located in the vicinity, the backrest 1 can move faithfully in accordance with the upper body of the sitter.

While in the foregoing, the first embodiment of the present invention is described, the specific constitutions of the respective components are not limited to only the above-described embodiment.

Hereinafter, another embodiment of the present invention is described, and components having actions similar to those of the above-described embodiment are indicated by like reference numerals, whose detailed description is omitted.

Second Embodiment

A chair C2 according to a second embodiment of the present invention, as shown in FIGS. 10 to 15, is constituted such that upper frame portion biasing means X1 is made of a torsion coil spring 17*sp*, which is an elastic member, provided between the above-described upper frame portion 14 and lower frame portion 13, and includes repulsive force changing means X11, described later, that can change an initial repulsive force of the torsion coil spring 17*sp* by changing a locking position of the relevant torsion coil spring 17*sp*. Furthermore, a regulator 19 is mounted to provide a movement range setting mechanism A that can change a movement range of the upper frame portion 14 corresponding to the position of the lower frame portion 13.

Hereinafter, a constitution of the chair C2 according to this embodiment is described.

Figure 10:
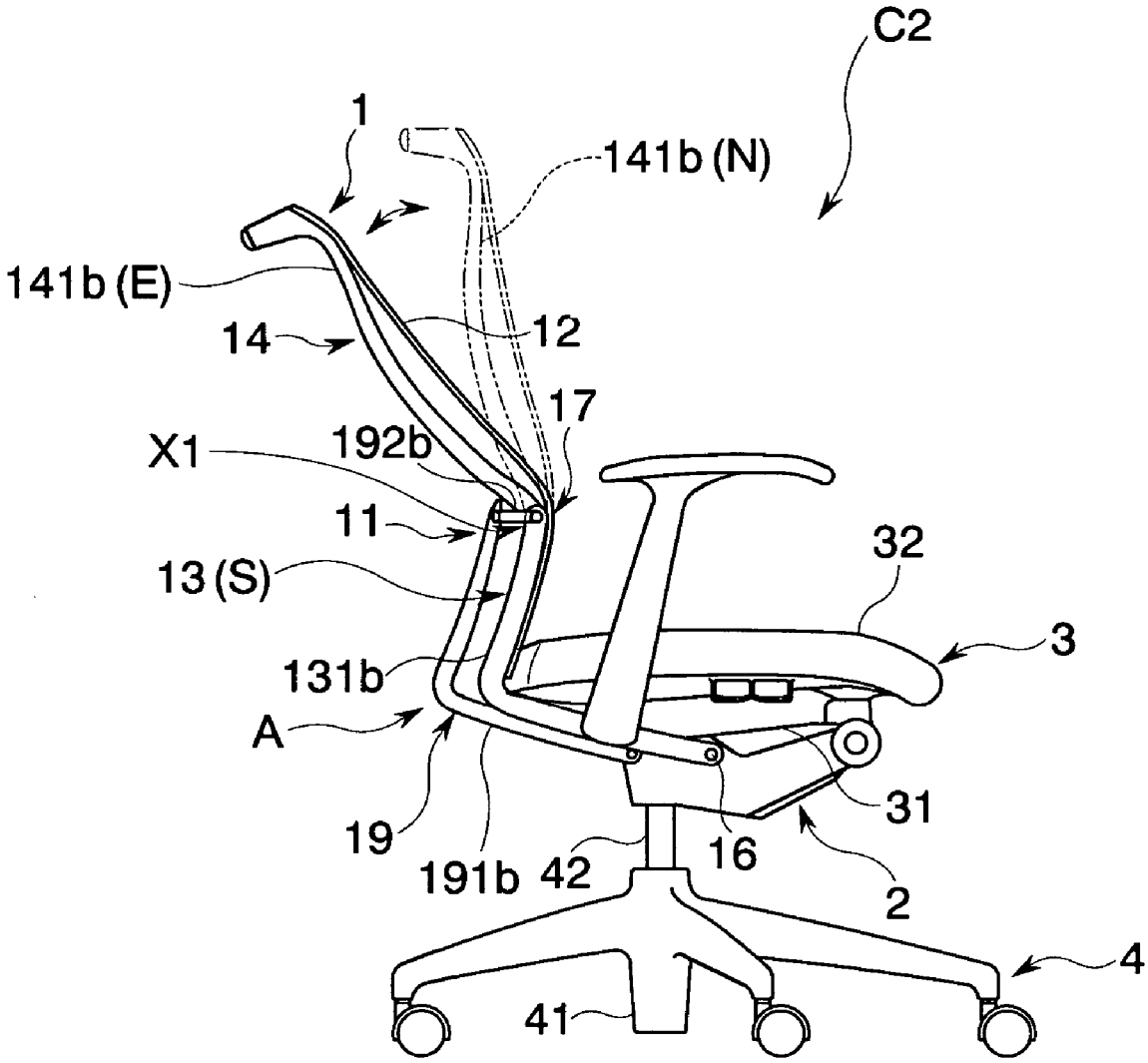
FIG. 10 is a side view showing a chair according to a second embodiment of the present invention.
Figure 11:
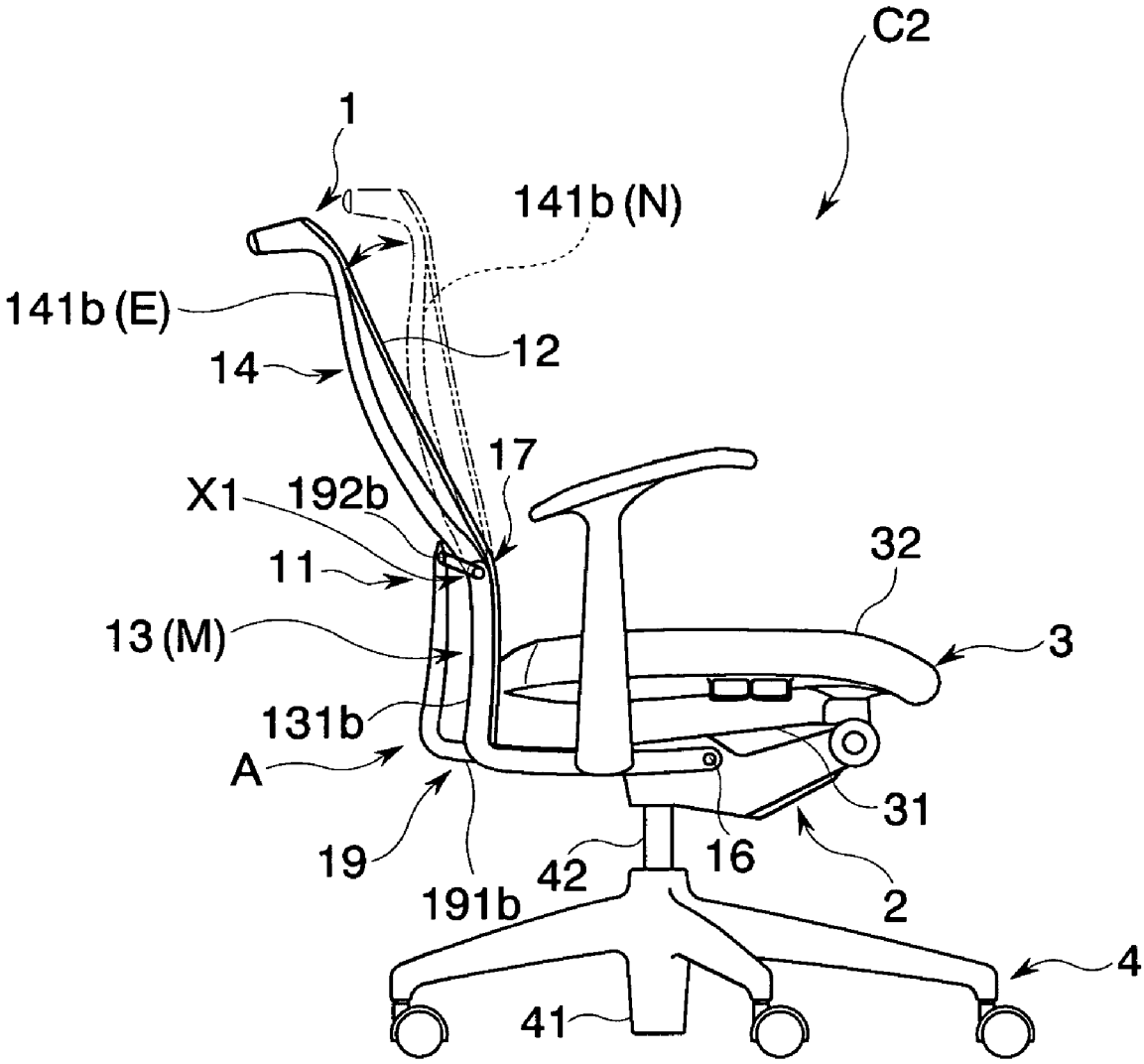
FIG. 11 is a view for explaining a movement, corresponding to FIG. 10.
Figure 12:
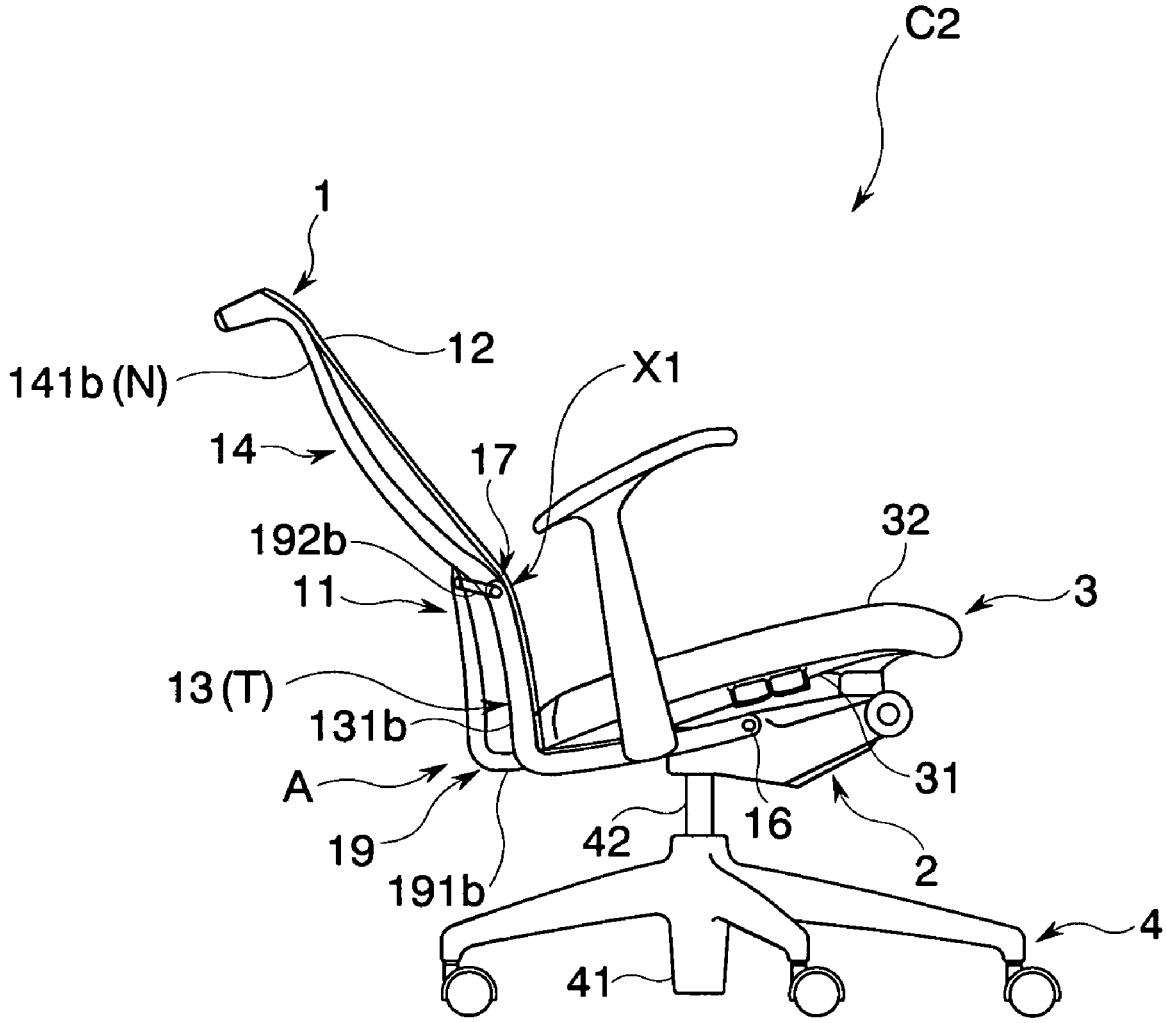
FIG. 12 is a view for explaining the movement, corresponding to FIG. 10.

The regulator 19, as shown in FIGS. 10 to 12, has regulating members 191*a*, 191*b* and link elements 192*a*, 192*b*. The regulator 19 forms a substantially-L-shaped frames extending along the lower frame elements 131*a*, 131*b* and the upper frame elements 141*a*, 141*b* in a side view, in which the regulating members 191*a*, 191*b* are turnably attached to the base 2 at lower end portions, and are turnably attached to the link elements 192*a*, 192*b* in the vicinity of upper end portions thereof. The upper ends of the regulator 19 are contacting end portions 191*a*1, 191*b*1 that can contact the upper frame elements 141*a*, 141*b* to thereby determine the rear end position (E) of the upper frame portion 14, or prohibit the rocking movement itself of the upper frame portion 14. The link elements 192*a*, 192*b* are turnably attached to the hinges 17 and the regulating members 191*a*, 191*b* at both end portions thereof. With the above-described constitution, a so-called parallel link mechanism made of the regulating members 191*a*, 191*b*, the link elements 192*a*, 192*b*, the lower frame elements 131*a*, 131*b*, and the base 2 is realized, by which the relevant movement range setting mechanism A is made up.

Figure 13:
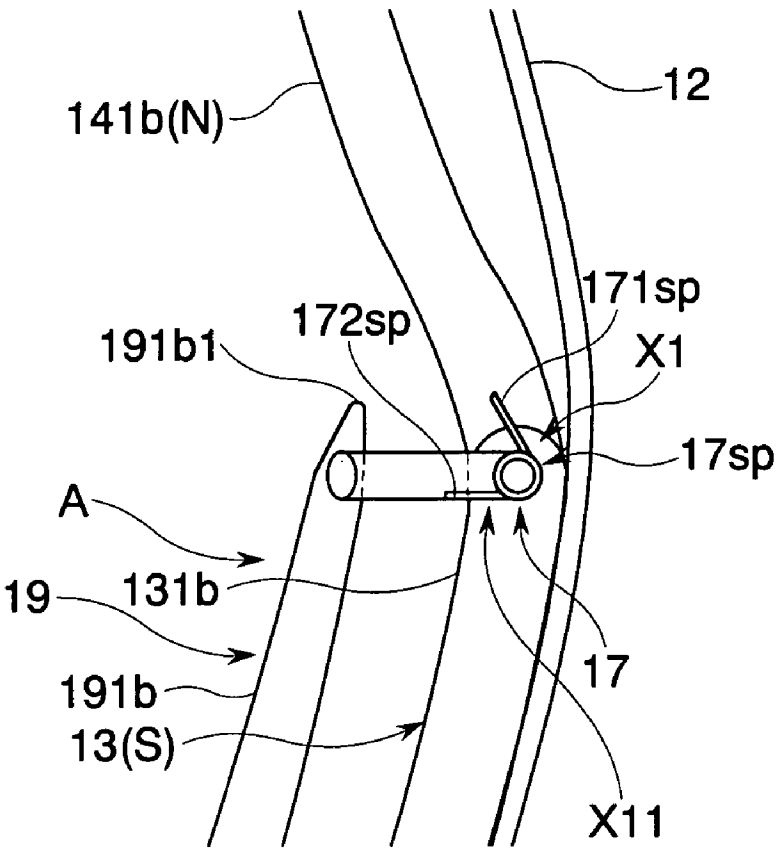
FIG. 13 is a view for explaining a major portion according to the second embodiment of the present invention.
Figure 14:
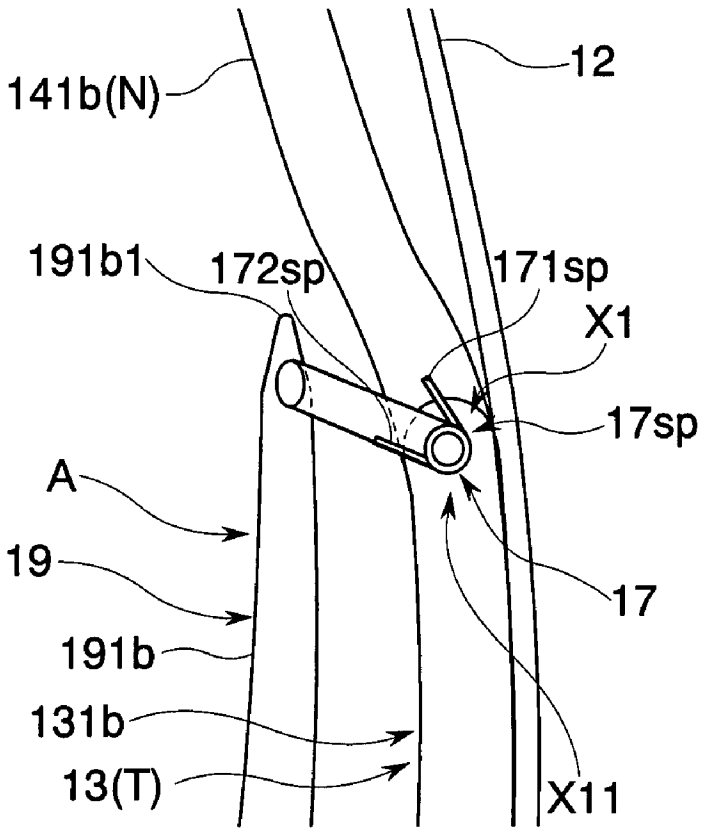
FIG. 14 is a view for explaining the major portion according to the second embodiment of the present invention.

The upper frame portion biasing means X1, as shown in FIGS. 13 and 14, is adapted to set the elastically biasing force to the upper frame portion 14 stronger as the lower frame portion 13 becomes closer to the rearward tilting position (T). More specifically, the upper frame portion biasing means X1, as shown in the same figures, is mainly made of the torsion coil spring 17*sp*, which is an elastic member, provided between the upper frame portion 14 and the lower frame portion 13, that is, in the vicinity of the hinge 17. One end 171*sp* of the relevant torsion coil spring 17*sp* is fixed to each of the upper frame elements 141*a*, 141*b*, and another end 172*sp* is fixed to each of the link elements 192*a*, 192*b*. That is, the relevant upper frame portion biasing means X1 makes up the repulsive force changing means X11 capable of changing the initial repulsive force of the above-described torsion coil spring 17*sp* by changing the locking position of the torsion coil spring 17*sp* by the torsion coil spring 17*sp*, each of the link elements 191*a*, 191*b*, and each of the upper frame elements 141*a*, 141*b*.

Hereinafter, the change in the movement range of the upper frame portion 14 by the movement range setting mechanism A is described in detail.

As shown in FIGS. 10 to 12, as the lower frame portion 13 performs the rocking movement from the standing position (S) as shown in FIG. 10 to an intermediate position (M) as shown in FIG. 11 and the rearward tilting position (T) as shown in FIG. 12, the regulating members 191*a*, 191*b* gradually rise and become closer to the normal position (N) of the upper frame portion 14, by which the movement range from the relevant normal position (N) to the rear end position (E) gradually becomes narrower (FIG. 10), until the rocking movement is not activated in the rear end position (E) (FIG. 12). Specifically, as the lower frame portion 13 is performing the rocking movement from the standing position (S), to the intermediate position (M) and the rearward tilting position (T), the contacting end portions 191*a*1, 191*b*1 of the regulating members 191*a*, 191*b* gradually rise closer to the upper frame elements 141*a*, 141*b*, and in the rearward tilting position (T), the contacting end portions 191*a*1, 191*b*1 come into contact with the upper frame elements 141*a*, 141*b*, which prohibits the rocking movement of the upper frame elements 141*a*, 141*b*. In other words, in the rear end position (T) of the lower frame portion 13, the contacting end portions 191*a*1, 191*b*1 come into contact with the upper frame element 141*a*, 141*b*, and thereby, the normal position (N) and the rear end position (E) of the upper frame elements 141*a*, 141*b* are located in the same position. While each of the hinges 17 also has a forward contacting portion that determines the normal position (N) of the upper frame 14, for a constitution for regulating the movement of the hinge 17 in the relevant normal position (N), various existing constitutions can be employed, and thus, a detailed description is omitted in the present embodiment.

In the upper frame portion biasing means X1, as shown in FIGS. 13 and 14, when the lower frame portion 13 performs the rocking movement toward the rearward tilting position (T) from the standing position (S) as shown in FIG. 13 to the intermediate position (M) as shown in FIG. 14, a relative angle between the one end 171*sp* and the other end 172*sp* of the torsion coil spring 17*sp* changes with the change of a relative angle of each of the link elements 192*a*, 192*b* with respect to each of the upper frame elements 141*a*, 141*b*. With this, the torsion strength of the torsion coil spring 17*sp* increases, which allows a stronger elastically-biasing-force to be applied to each of the upper frame elements 141*a*, 141*b*.

Since the chair according to the second embodiment of the present invention as described above is provided with the movement range setting mechanism A, which sets the movement range of the upper frame elements 141, 141*b* narrower as the lower frame portion 13 become closer to the rearward tilting position (T), the chair is adapted such that the backrest 11 can follow the motion of the upper body of the sitter without disturbing it when the sitter raises his or her upper body during execution of business or the like, and that the upper frame elements 141*a*, 141*b* can preferably support the upper body of the sitter respectively when the lower frame portion 13 is tilted rearward by inclining the sitter's upper body when the sitter leaning against the backrest 11 or the like.

Furthermore, since the movement range setting mechanism A is adapted such that as the lower frame portion 13 becomes closer to the rearward tilting position (T), the above-described upper frame rear end position (E) becomes closer to the normal position (N), the lower frame portion 13 can be tilted rearward with the upper body stable. Moreover, in the present embodiment, since the movement range setting mechanism A is adapted so as to prohibit the movement of the upper frame elements 141*a*, 141*b* when the lower frame portion 13 reaches the rearward tilting position (T), the upper body of the sitter in the rearward tilting position (T) can be preferably supported.

In the present embodiment, specifically, by applying the regulator 19, the contacting end portions 191*a*1, 191*b*1 of the regulating members 191*a*, 191*b* gradually become closer to the normal position (N) of the upper frame elements 141*a*, 141*b* corresponding to the rocking movement in which the lower frame portion 13 is tilted rearward, and come into contact with the upper frame elements 141*a*, 141*b* when the upper frame elements 141*a*, 141*b* are located in the rear end position (E) to prohibit the movement of the upper frame elements 141*a*, 141*b*. With such a constitution, only by adding the two kinds of components of the regulating members 191*a*, 191*b* and the link elements 192*a*, 192*b*, the movement range setting mechanism A capable of setting the movement range of the upper frame elements 141*a*, 141*b* in a continuous manner is preferably made up.

Moreover, by supporting the regulating members 191*a*, 191*b* by the base 2, a parallel link structure is preferably made up to preferably correspond to the movement of the lower frame portion 13.

Figure 15:
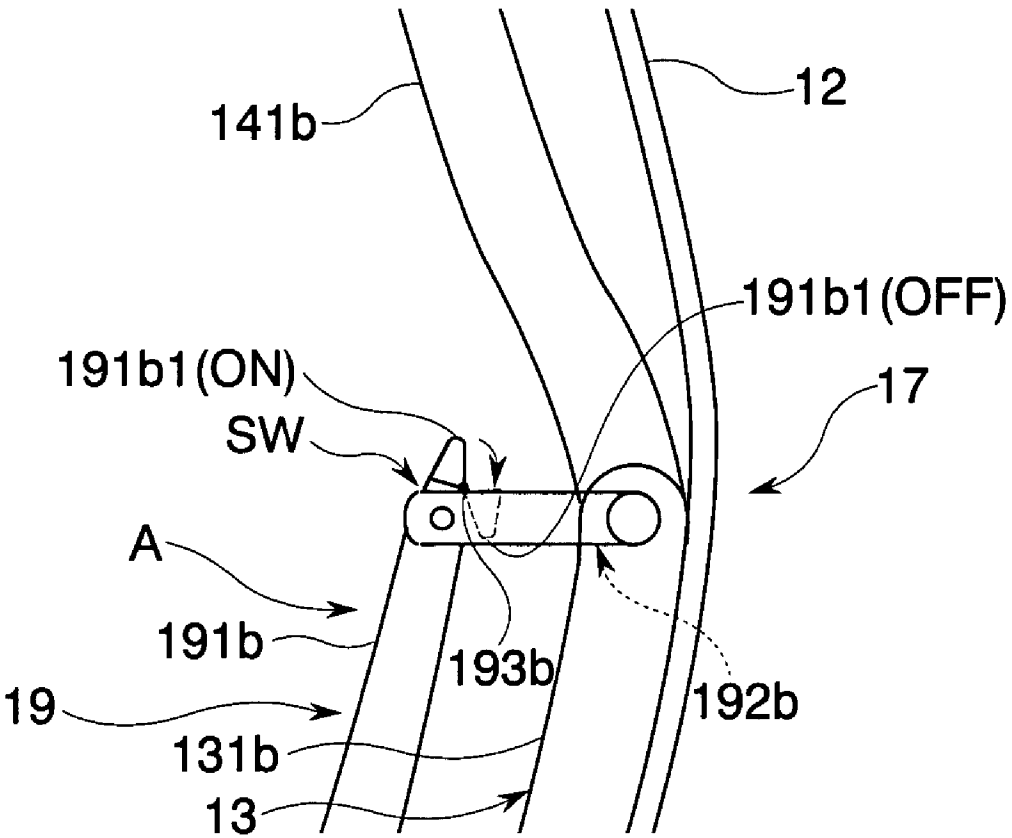
FIG. 15 is a side view of a modified embodiment of the present invention.

As a modification of the present embodiment, for example, as shown in FIG. 15, a switching mechanism SW for temporarily stopping the above-described function of the movement range setting mechanism A may be provided. Specifically, a folding portion 193*b* in the vicinity of each of the contacting end portions 191*a*1, 191*b*1 of the regulating members 191*a*, 191*b* is provided, and rotating the relevant folding portion 193*b* as necessary allows switching between an on state (ON) in which each of the contacting end portions 191*a*1, 191*b*1 comes into contact with each of the upper frame elements 141*a*, 141*b*, and an off state (OFF) indicated by a dashed line, in which each of the contacting end portions 191*a*1, 191*b*1 cannot come into contact with each of the upper frame elements 141*a*, 141*b*.

Figure 16:
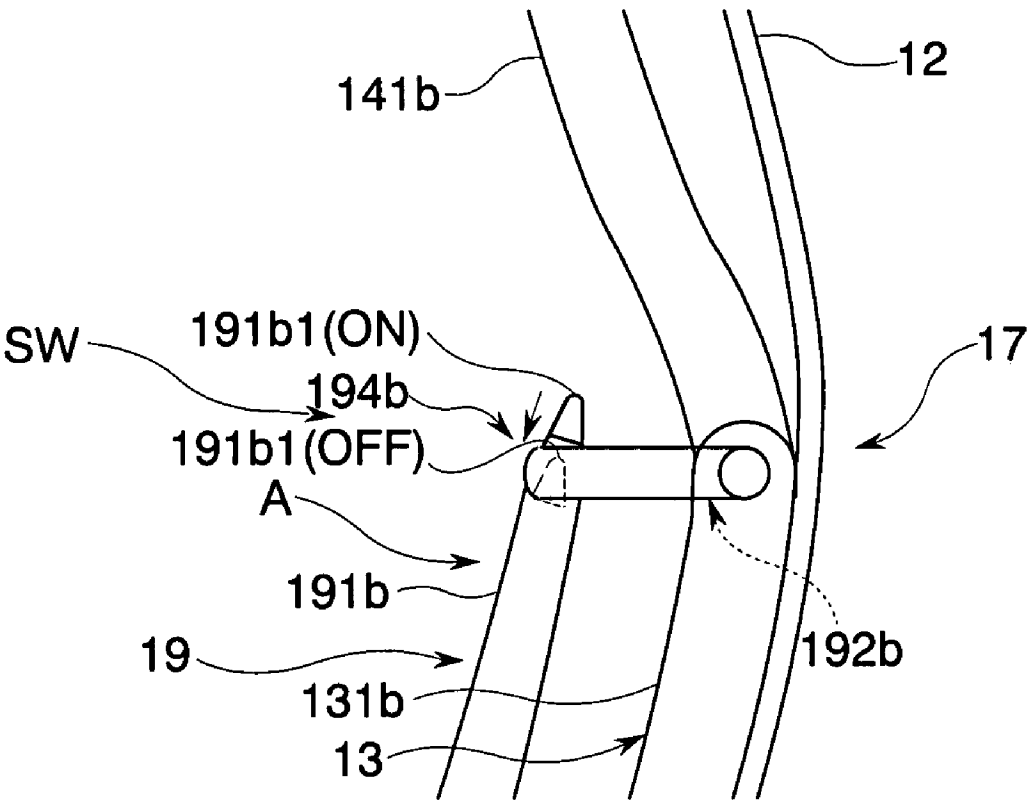
FIG. 16 is a side view of the modified embodiment of the present invention.

Furthermore, as shown in FIG. 16, a projecting and sinking regulating member 194*b* may be provided in the vicinity of each of the contacting end portions 191*a*1, 191*b*1 of the regulating members 191*a*, 191*b*, and by operating the projecting and sinking regulating member 194*b* as necessary to perform a projecting and sinking movement in each of the contacting end portions 191*a*1, 191*b*1, switching can be performed between the on state (ON) in which each of the contacting end portions 191*a*1, 191*b*1 comes into contact with the upper frame elements 141*a*, 141*b*, and the off state (OFF) indicated by a dashed line, in which each of the contacting end portions 191*a*1, 191*b*1 cannot come into contact with the each of the upper frame elements 141*a*, 141*b*.

With the above-described constitution, the setting of the movement range setting mechanism A can be switched to temporarily stop the function of the relevant movement range setting mechanism A as desired by the sitter.

Figure 17:
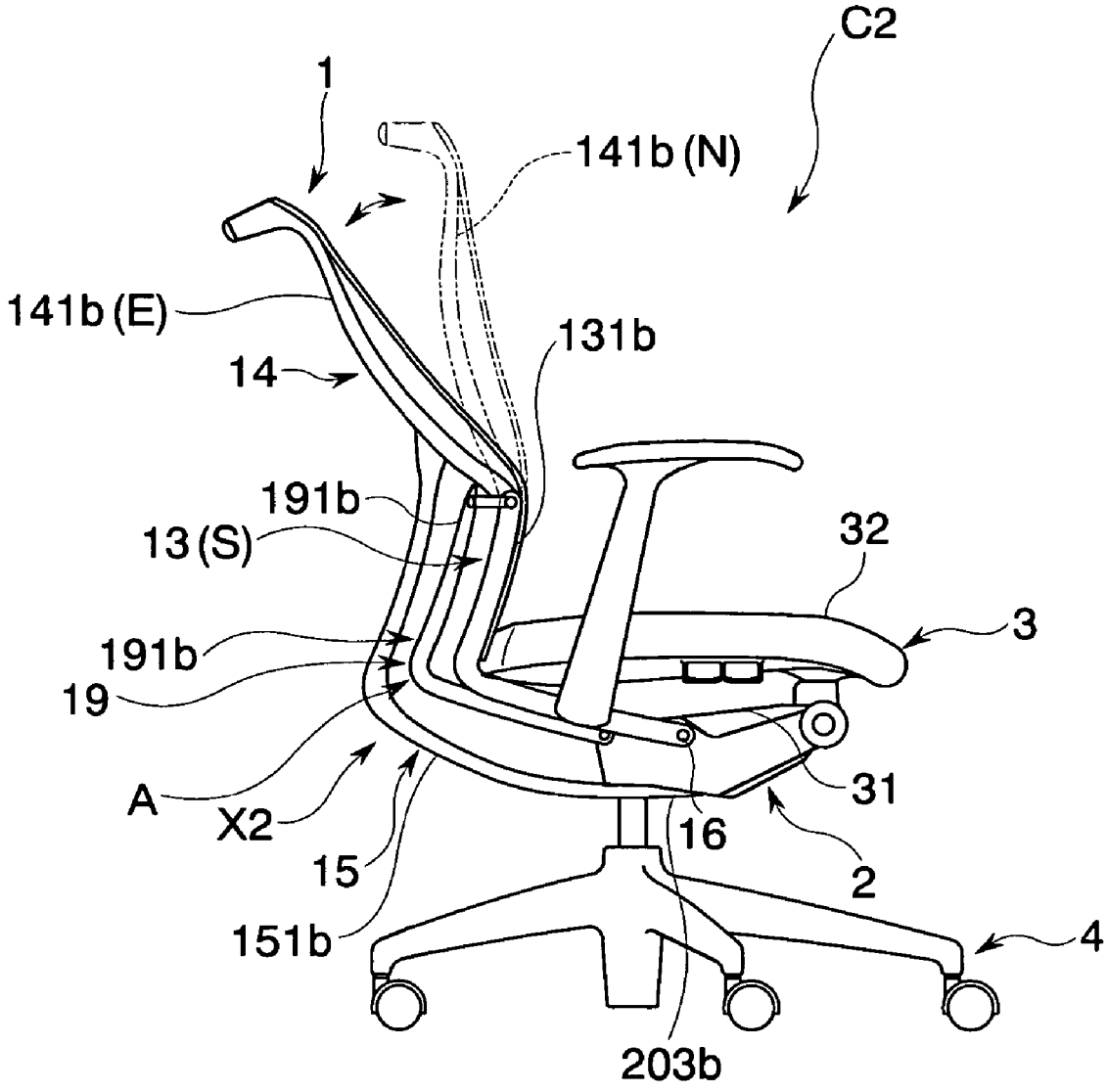
FIG. 17 is a side view of another modified embodiment of the present invention.

Furthermore, as another modification of the present embodiment, as shown in FIG. 17, instead of the torsion coil spring 17*sp*, the reactive force frame portion 15 similar to that of the above-described first embodiment may be provided. With such a constitution, the movement range setting mechanism and the upper frame portion biasing means preferably act in combination.

With such a constitution, a constitution can be realized in which the upper body of the sitter is supported more stably, as the lower frame portion 13 is tilted rearward.

Third Embodiment

Next, a chair C3 according to a third embodiment of the present invention is described.

Figure 18:
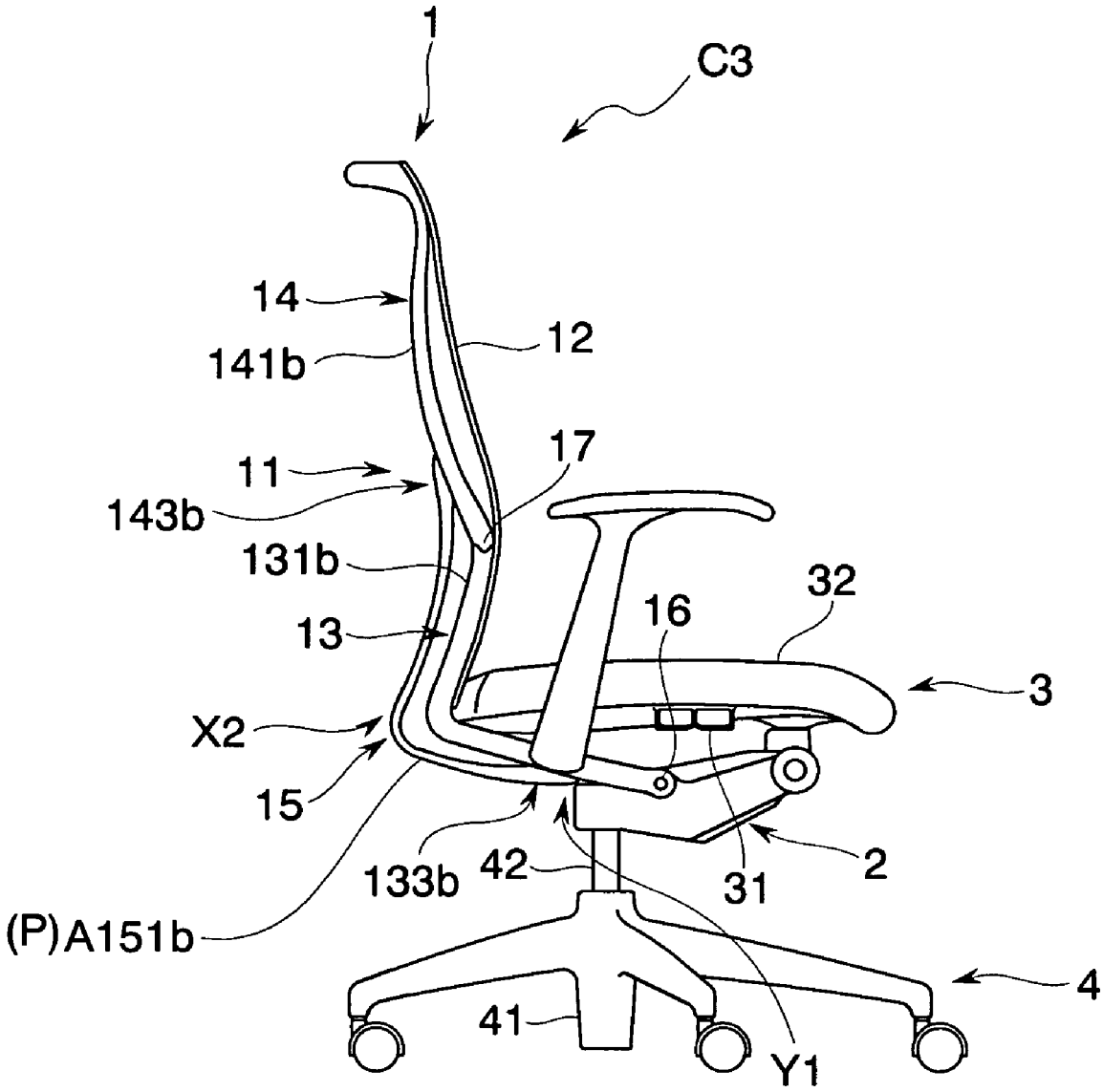
FIG. 18 is a view for explaining a constitution according to a third embodiment of the present invention.
Figure 19:
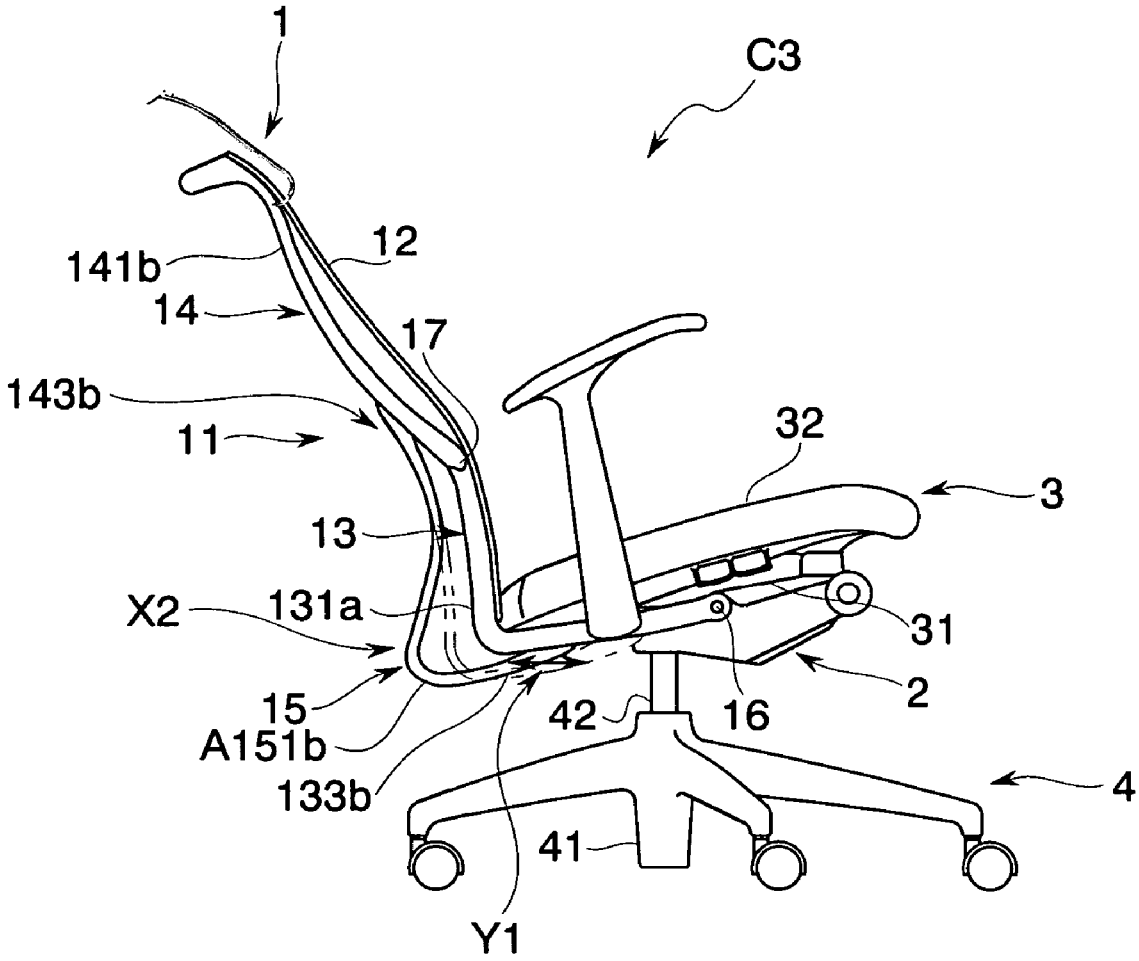
FIG. 19 is a view for explaining a movement according to the third embodiment of the present invention.

In the chair C3 according to the present embodiment, as shown in FIGS. 18, 19, upper frame portion biasing means X2 is made up by providing the reactive force frame portion 15 made of reactive force frame elements A151*a*, A151*b*, which are resin springs, between the upper frame portion 14 and the lower frame portion 13, as an elastic member. Further, there is provided supporting position changing means Y1 capable of changing a supporting position where the reactive force frame elements A151*a*, A151*b* are supported, corresponding to the rocking movement of the lower frame portion 13. As a specific constitution of the supporting position changing means Y1, various mechanisms or structures such as position change by gear or position change employing a link mechanism can be employed.

With the above-described mechanisms or structures, the elastic repulsive force can preferably be applied to the reactive force frame elements A151*a*, A151*b*, and the relevant elastic repulsive force is surely changed, thereby changing the elastically biasing force of the reactive force frame elements A151*a*, A151*b*.

Fourth Embodiment

Next, a chair C4 according to a fourth embodiment of the present invention is described.

Figure 20:
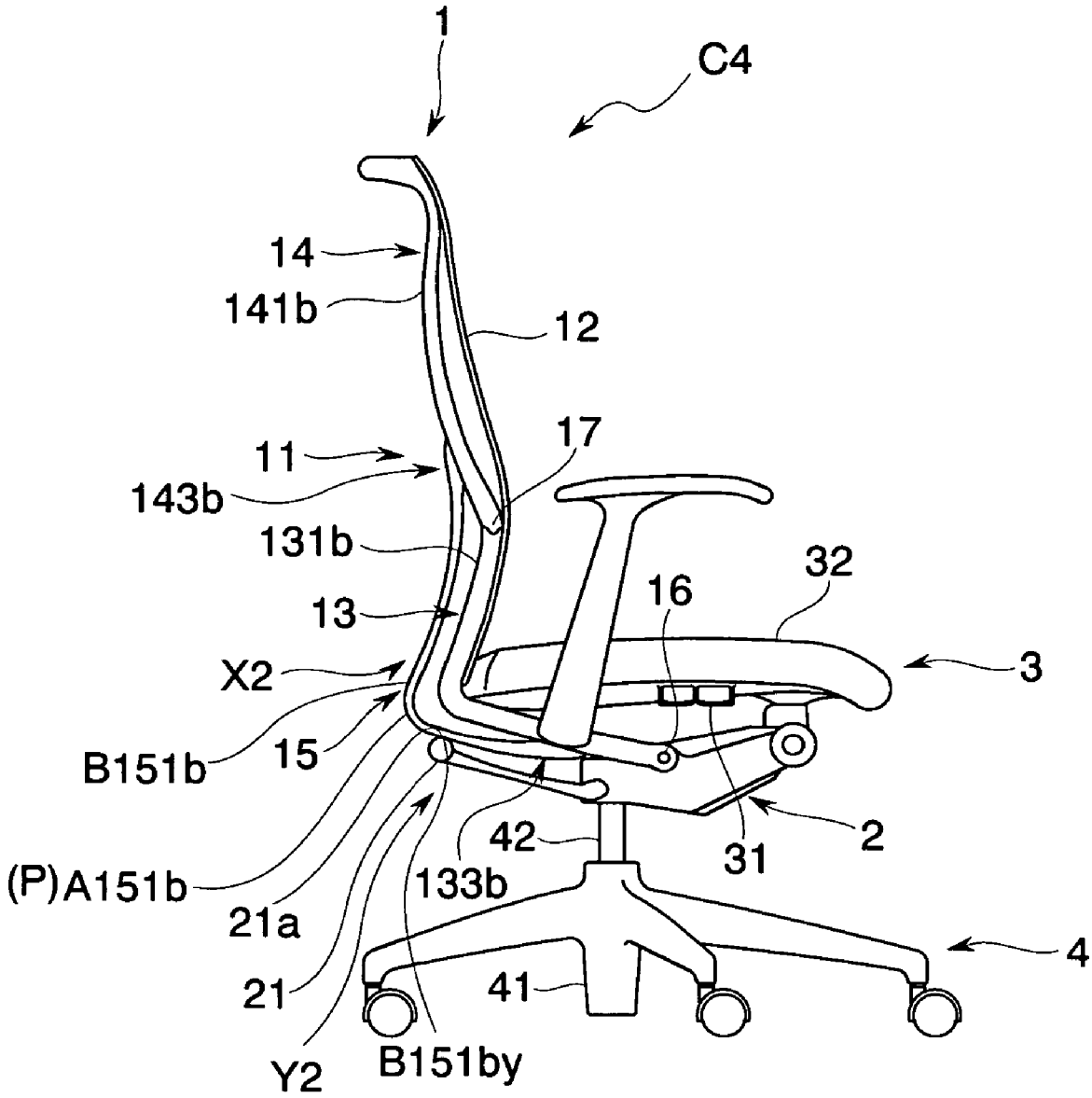
FIG. 20 is a view for explaining a constitution according to a fourth embodiment of the present invention.
Figure 21:
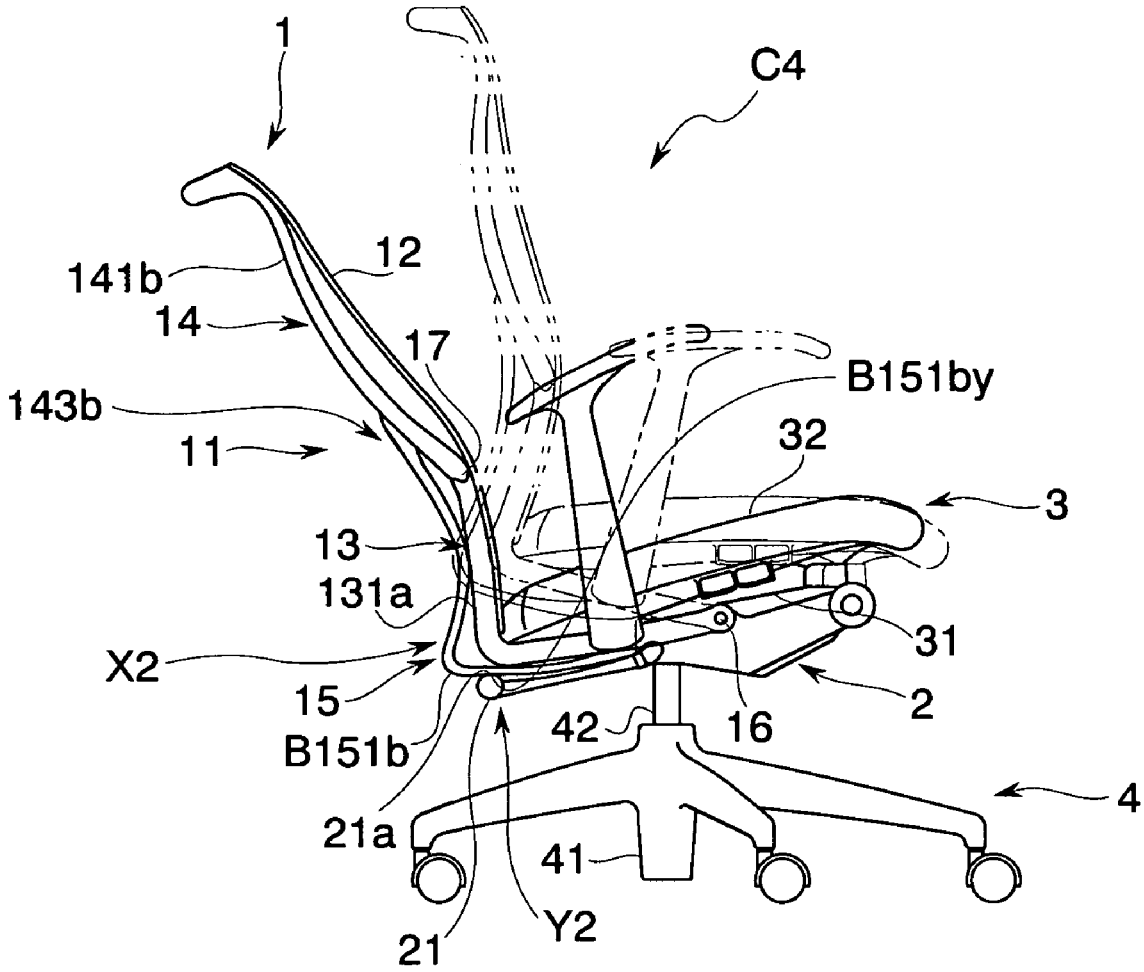
FIG. 21 is a view for explaining a movement according to the fourth embodiment of the present invention.

In the chair C4 according to the present embodiment, as shown in FIGS. 20, 21, the upper frame portion biasing means X2 is made up by providing the reactive force frame portion 15 made of the reactive force frame elements B151*a*, B151*b*, which are resin springs, between the upper frame portion 14 and the lower frame portion 13, as an elastic member. Moreover, interfering supporting point 21*a* that comes into contact with each of intermediate portions B151*ay*, B151*by* of the reactive force frame elements B151*a*, B151*b* when the relevant reactive force frame elements B151*a*, B151*b* inflect is provided to thereby provide a supporting point forming member 21 that interferes with inflecting movement. Specifically, the supporting point forming member 21 is fixed to the base 2, by which the position of the interfering supporting point 21*a* is changed relatively corresponding to the movement of the lower frame portion 13. With such a constitution, the supporting point forming member 21 can simultaneously bring about an action of supporting point changing means Y2 capable of changing the fixing position of the relevant supporting point forming member 21 with respect to each of the reactive force frame elements B151*a*, B151*b* corresponding to the above-described rocking movement of the lower frame portion 13.

The above-described constitution can also preferably change the elastic repulsive force of the reactive force frame elements B151*a*, 151*b* corresponding to the movement of the lower frame portion 13.

While in the foregoing, the respective embodiments of the present invention are described, the specific constitutions of the respective components are not limited to the above-described embodiments. For example, the above-described supporting position changing means and the supporting point changing means are not limited to the aspects used for the reactive force frame elements provided between the upper frame portion and the lower frame portion, but may be applied to the reactive force frame elements in the above-described first embodiment.

Additionally, the specific constitutions of the respective components are not limited to the above-described embodiments, but various modifications can be made within a range not departing from the gist of the present invention.

What is claimed is:

1. A chair, comprising:

a leg body, a base supported by the leg body, and a back frame supported by the base, said back frame including a pair of lower frame elements rockable between a standing position and a rearward tilting position with respect to the base, and a pair of upper frame elements rockable between a normal position and a rear end position with respect to the corresponding one of said pair of lower frame elements, and a pair of reactive force frame elements, each of which elastically biases the corresponding one of said pair of upper frame elements from said rear end position to said normal position, wherein each of said pair of reactive force frame elements changes the elastically biasing force on the corresponding one of said pair of upper frame elements in accordance with rocking movement of the corresponding one of said pair of lower frame elements and is attached at a lower end thereof to said base, wherein said pair of upper frame elements are rockable independently of each other, wherein said pair of upper frame elements extend to the top of said back frame, and wherein each of said pair of lower frame elements is arranged on a right and left side of said chair and forms a substantially L-shape bent upward at a rear end, in a side view.

2. The chair according to claim 1, wherein the elastically biasing force of each of said pair of reactive force frame elements become stronger as the corresponding one of said pair of lower frame elements comes closer to said rearward tilting position.

3. The chair according to claim 2, wherein each of said pair of reactive frame elements is an elastic member attached to said base and the corresponding one of said pair of upper frame elements.

4. The chair according to claim 3, wherein said elastic member is a spring having a shape of a frame.

5. A chair, comprising:

a leg body, a base supported by the leg body, and a back frame supported by the base, said back frame including a pair of lower frame elements rockable between a standing position and a rearward tilting position with respect to the base, and a pair of upper frame elements rockable between a normal position and a rear end position with respect to the corresponding one of said pair of lower frame elements, and a pair of reactive force frame elements, each of which is attached at an upper end thereof to a lower end of a corresponding one of said pair of upper frame elements and is attached at a lower end thereof to said base, wherein when said pair of lower frame elements of said back frame are in the rearward tilting position, said upper and lower ends of said pair of reactive force frame elements are closer to each other than when said pair of lower frame elements of said back frame are in the standing position, wherein said pair of upper frame elements are rockable independently of each other, wherein said pair of upper frame elements extend to the top of said back frame, and wherein each of said pair of lower frame elements is arranged on a right and left side of said chair and forms a substantially L-shape bent upward at a rear end, in a side view.

6. A chair, comprising:

a leg body, a base supported by the leg body, and a back frame supported by the base, said back frame including a lower frame element rockable between a standing position and a rearward tilting position with respect to the base, and an upper frame element rockable between a normal position and a rear end position with respect to the lower frame element, and a reactive force frame element which is attached at an upper end thereof to a lower end of said upper frame element and is attached at a lower end thereof to said base, wherein when said lower frame element of said back frame is in the rearward tilting position, said upper and lower ends of said reactive force frame element are closer to each other than when said lower frame element of said back frame is in a standing position, wherein said pair of upper frame element extend to the top of said back frame, and wherein said lower frame element forms a substantially L-shape bent upward at a rear end, in a side view.

* * * * *